US010004334B2

(12) United States Patent
Robertson

(10) Patent No.: US 10,004,334 B2
(45) Date of Patent: Jun. 26, 2018

(54) LIFT-RECLINER CHAIR

(71) Applicant: INTEGRATED FURNITURE TECHNOLOGIES LIMITED, Cheltenham (GB)

(72) Inventor: Dale Robertson, Cheltenham (GB)

(73) Assignee: INTEGRATED FURNITURE TECHNOLOGIES LIMITED, Gloucestershire (GB)

( * ) Notice: Subject to any disclaimer, the term of this patent is extended or adjusted under 35 U.S.C. 154(b) by 83 days.

(21) Appl. No.: 14/972,975

(22) Filed: Dec. 17, 2015

(65) Prior Publication Data

US 2016/0206099 A1 Jul. 21, 2016

Related U.S. Application Data

(63) Continuation of application No. PCT/GB2014/000385, filed on Sep. 29, 2014, and a (Continued)

(30) Foreign Application Priority Data

Sep. 9, 2010 (GB) ..... 1015084.5
Sep. 30, 2013 (GB) ..... 1317259.8

(51) Int. Cl.
*A47C 1/032* (2006.01)
*A61G 5/14* (2006.01)
*A47C 1/029* (2006.01)

(52) U.S. Cl.
CPC ..... *A47C 1/03294* (2013.01); *A47C 1/029* (2013.01); *A47C 1/032* (2013.01); *A61G 5/14* (2013.01)

(58) Field of Classification Search
None
See application file for complete search history.

(56) References Cited

U.S. PATENT DOCUMENTS 638,466 A 12/1899 Kelly
912,214 A 2/1909 Ward
(Continued)

FOREIGN PATENT DOCUMENTS

DE 029715343 1/1998
DE 010152227 5/2003
(Continued)

OTHER PUBLICATIONS

U.S. Appl. No. 13/390,985, filed Feb. 17, 2012, Office Action dated Jan. 7, 2015, 20 pages.
(Continued)

*Primary Examiner* — David E Allred
(74) *Attorney, Agent, or Firm* — Andrew F. Young, Esq.; Lackenbach Siegel, LLP

(57) ABSTRACT

A power lift-recliner chair has a base, seat and backrest sections and actuator for moving the seat and backrest sections. The seat is pivotally mounted with respect to the base section and the backrest section is pivotally mounted with respect to the seat section. A guide is associated with one of the base and the seat sections and at least one follower is associated with the other of the base and the seat sections. The guide is arcuate for relative pivoting with respect to the base about a pivot axis located at the center of curvature of the guide. The base section includes a pair of side panels on lateral sides of the chair. The seat includes a pair of side members, adjacent the side panels, which carry the guide or follower associated with the seat section.

30 Claims, 26 Drawing Sheets

Related U.S. Application Data continuation-in-part of application No. 14/845,354, filed on Sep. 4, 2015, now Pat. No. 9,808,385, which is a continuation of application No. 13/818,678, filed as application No. PCT/GB2011/001329 on Sep. 9, 2011, now Pat. No. 9,155,388.

(56) References Cited

U.S. PATENT DOCUMENTS

| | | | | |
|---|---|---|---|---|
| 1,238,078 | A | 8/1917 | Ault | |
| 1,414,637 | A | 5/1922 | Gell | |
| 2,954,072 | A | 9/1960 | Fossati | |
| 3,086,814 | A | 4/1963 | Fletcher | |
| 3,121,589 | A | 2/1964 | Schliephacke | |
| 3,202,453 | A | 8/1965 | Richards | |
| 3,369,767 | A | 2/1968 | Greenfield | |
| 3,873,152 | A | 3/1975 | Garas | |
| 4,547,017 | A | 10/1985 | Leseure | |
| 4,635,999 | A | 1/1987 | Simpson | |
| 5,112,109 | A | 5/1992 | Takada et al. | |
| 5,246,266 | A | 9/1993 | Ostergaard | |
| 5,785,384 | A | 7/1998 | Sagstuen | |
| 5,897,462 | A | 4/1999 | St. Germain | |
| 6,059,364 | A | 5/2000 | Dryburgh et al. | |
| 6,568,755 | B1 | 5/2003 | Groening | |
| 6,641,214 | B2 | 11/2003 | Veneruso | |
| 6,739,661 | B1 | 5/2004 | Dukes | |
| 7,219,958 | B2 | 5/2007 | Yamazaki et al. | |
| 7,390,060 | B2 | 6/2008 | Kristen | |
| 7,445,279 | B2 | 11/2008 | Crum | |
| 7,641,277 | B2 | 1/2010 | Lawson et al. | |
| 7,703,851 | B2 | 4/2010 | Nakaya et al. | |
| 7,997,654 | B2 | 8/2011 | Ferry et al. | |
| 8,303,036 | B2 | 11/2012 | Hankinson et al. | |
| 8,403,415 | B2 | 3/2013 | Lawson | |
| 8,424,964 | B2 | 4/2013 | Campbell et al. | |
| 8,534,758 | B2 | 9/2013 | Rivera | |
| 2002/0060483 | A1 | 5/2002 | Yoshida et al. | |
| 2003/0172455 | A1 | 9/2003 | Roma et al. | |
| 2004/0155504 | A1 | 8/2004 | Tada | |
| 2007/0120409 | A1 | 5/2007 | Leeds | |
| 2007/0158980 | A1 | 7/2007 | LaPointe et al. | |
| 2008/0150329 | A1 | 6/2008 | Lawson | |
| 2009/0152921 | A1* | 6/2009 | Johnson | A47C 1/03255 297/300.2 |
| 2010/0212087 | A1* | 8/2010 | Leib | A61G 12/00 5/81.1 R |
| 2011/0248530 | A1 | 10/2011 | Sartisohn | |
| 2014/0306502 | A1* | 10/2014 | Manuel | A47C 3/0257 297/261.1 |
| 2016/0128883 | A1* | 5/2016 | Robertson | A61G 7/015 5/618 |

FOREIGN PATENT DOCUMENTS

| | | |
|---|---|---|
| DE | 10 2007 024 218 | 11/2008 |
| DE | 102007024218 | 11/2008 |
| EP | 0781518 | 12/1996 |
| EP | 0865960 | 3/1998 |
| GB | 0101239 | 8/1916 |
| GB | 0329834 | 5/1930 |
| GB | 0414464 | 8/1934 |
| GB | 0775679 | 5/1957 |
| GB | 2227932 | 8/1990 |
| GB | 2486335 | 6/2012 |
| GB | 2501993 | 4/2014 |
| GB | 191322022 | 8/2014 |
| JP | 36-13946 | 5/1936 |
| JP | 08-173263 | 7/1996 |
| JP | 08-308680 | 11/1996 |
| JP | 11-244096 | 9/1999 |
| JP | 2003-144262 | 5/2003 |
| WO | WO 2005/051128 | 6/2005 |
| WO | WO 2006/023447 | 3/2006 |
| WO | WO 2007/124067 | 11/2007 |
| WO | WO/2011/021002 | 2/2011 |
| WO | WO 2012/032305 | 3/2012 |
| WO | WO 2014/183112 | 11/2014 |

OTHER PUBLICATIONS

Pat. No. GB 1417108.6, Combined Search and Examination Report dated Mar. 26. 2015, 7 pages—English.

EasyCliner® wood-to-the-floor recliner mechanism, 1 page, HomeFurnitureComponents.com, Apr. 10, 2015.

PCT/GB2010/001565 International Search Report dated Apr. 12, 2011, 6 pages—English.

GB1417107.8, Examination Report, dated Dec. 21, 2017, 5 pages—English.

* cited by examiner

LIFT-RECLINER CHAIR

CROSS REFERENCE TO RELATED APPLICATIONS

This application relates to and claims priority as a continuation of Ser. No. PCT/GB2014/000385 filed Sep. 29, 2014, the entire contents of which are incorporated herein by reference, which in turn claims priority from GB Ser. No. 1317259.8 filed Sep. 30, 2013.

This application also relates to and claims priority as a continuation-in-part of U.S. Ser. No. 14/845,354 filed Sep. 4, 2015, which in turn is a continuation of U.S. Ser. No. 13/818,678 filed Apr. 29, 2013, issued as U.S. Pat. No. 9,155,388 on Oct. 13, 2015, which in turn is a § 371 national phase of Ser. PCT/GB2011/001329 filed Sep. 9, 2011, the entire contents of which are incorporated herein by reference, which in turn claims priority from GB Ser. No. 1015084.5 filed Sep. 9, 2010

FIGURE SELECTED FOR PUBLICATION

FIG. 3

BACKGROUND OF THE INVENTION

This invention relates to powered lift-recliner chairs, and in particular concerns lift-recliner chairs of the type where the actuator and support arrangement for moving the adjustable parts of the chair is integrated into the structure of the chair.

Integrated lift-recliner chairs, as disclosed in WO2005/051128 and WO2008/132481, typically comprise a number of relatively moveable sections, including a floor standing base section, an angularly adjustable seat section, and an adjustable backrest section pivotally connected to the seat section. The seat is movable between a generally horizontal seating position and an inclined or tilted raised position to assist the occupant moving between seated and standing positions. An adjustable foot rest may also be provided. In the above examples the base and seat sections each comprises a pair of side panels arranged substantially parallel with each other on both sides of the chair to shield the actuator arrangement located in the interior of the chair. The base and seat sections are arranged in a telescopic nesting configuration. The seat section is telescopically extendable from the base section to raise and lower the chair. Typically, each adjustable section is provided with a dedicated powered actuator, usually an electrical linear actuator or jack, for independent movement relative to other sections of the chair. In the lift recliner chair disclosed in FIG. 1 of WO2008/132481 the base and seat sections include respective actuator mounting brackets between which an actuator is mounted for moving the seat section relative to the base section about its pivot axis. Actuator mounting brackets are also provided on the seat section and the backrest between which a second actuator is mounted for moving the backrest relative to the seat section. In this arrangement, and in the arrangements disclosed in WO2005/051128, the recliner function of the chair is provided by the operation of a dedicated actuator and the lift function is independently provided by a further dedicated actuator. A lift and recline chair of the aforementioned type is also disclosed in WO2012/032305 which has a single actuator operative to provide both the lift and recline function of the chair.

WO2012/032305 concerns lift and recline arrangements which have a so called nesting configuration, that is to say a chair having an inner and outer frame with one of the frames comprising a fixed floor standing base frame and the other a movable seat frame that can be telescopically extended from the base. This arrangement provides for an inherently safe structure that eliminates many of the potential pinch and stress points commonly associated with moveable furniture. The telescopic nature of nesting inner and outer frames can however place some restriction on the aesthetics of the item of furniture and add additional design constraints. For example, in known nesting designs, the arm rests tend to be split, with part of the arm or armrest being associated with the fixed base frame and the other part being associated with the moveable seat frame. This can complicate the design and manufacturing process.

There is a requirement for an integrated type lift-recliner chair which has a simpler construction and reduced manufacturing costs when compared with known designs, and in particular one which enables greater design freedom, more particularly one that enables greater design freedom in relation to the arms or arm rests of the chair.

ASPECTS AND SUMMARY OF THE INVENTION

According to one aspect of the present invention, there is provided a power operated lift-recliner chair comprising a base section, movable seat and backrest sections and actuator means for moving the seat and backrest sections. The seat section is pivotally mounted with respect to the base section and the backrest section is pivotally mounted with respect to the seat section. A guide is associated with one of the base and the seat sections and at least one follower is associated with the other of the base and the seat sections and is movable along the guide. The guide is of arcuate form to guide the seat for relative pivoting movement with respect to the base about a pivot axis located at the centre of curvature of the guide to raise and lower the chair. The base section includes a pair of parallel side panels on respective lateral sides of the chair. The seat section includes a pair of elongate side members, adjacent the side panels, which carry the guide or follower associated with the seat section. The elongate side members provide a simple and effective means of mounting the seat section relative to the base, which allows the side panels of the base to provide a guard around the moving parts of the chair on the lateral sides of the chair, and also a fixed structure for mounting fixed arms/armrests on the side of the chair. In this way the fixed arms/armrests can be provided at a height which best suits the user for ingress and egress from the chair when raised and for comfortable sitting when the chair is lowered.

According to another aspect of the present invention there is provided a lift-recliner chair comprising a base section, movable seat and backrest sections and actuator means for moving the seat and backrest sections to alter the configuration of the chair, the seat section being pivotally mounted with respect to the base section and the backrest section being pivotally mounted with respect to the seat section, at least one guide associated with one of the base and the seat sections and at least one follower associated with the other of the base and the seat sections and movable along said guide, said guide being of arcuate form to guide the seat for relative pivoting like movement with respect to the base about a pivot axis located at the centre of curvature of the guide to raise and lower the chair, the base section having a pair of parallel side panels on respective lateral sides of the chair, the seat section having a pair of elongate side members, adjacent the side panels, which carry one of the said guide or follower associated with the seat section.

The elongate side members provide a simple but effective means of mounting the seat section relative to the base, which allows the side panels of the base not only to provide a guard around the moving parts of the chair on the lateral sides of the chair, but also a fixed structure for mounting fixed arms/armrests on the side of the chair. In this way the fixed arms can be provided at a height which best suits the user for ingress and egress when the chair is raised and for comfortable sitting when the chair is lowered. The design of the elongate side members can therefore be optimised in terms of size and weight for the single function of pivotally mounting the seat section relative to the base. Lateral shielding of the moving parts including the actuator is achieved solely by the side panels which are preferably dimensioned to enclose points of potential entrapment around the sides of the chair.

In preferred embodiments, the elongate side members each comprise an arcuate member, preferably a planar arcuate member. In this way the elongate side members can be approximately the same size and shape as the arcuate guides and be positioned closely adjacent the respective side panels.

The elongate side members preferably carry the at least one follower, preferably two, most preferably three followers. Preferably at least two of the followers are circumferentially spaced apart so that the potential for misalignment of the followers in the guides is reduced.

The guide is preferably provided in or on the side panels. In this way the followers are provided on the respective elongate members for mounting the seat section with respect to the base.

The elongate side members preferably lie parallel with and adjacent to the respective side panels.

Preferably, the elongate side members are disposed in the interior region of the chair between the side panels, preferably in all adjustment positions of the chair. In this way the elongate side members can be arranged so that they do not project beyond the top edge of the side panels in any position of the chair. As such the elongate side members may not compromise the aesthetic design of the chair. The elongate side members may therefore be considered to be hidden within the internal structure of the chair, completely hidden from view in the lowered or raised configuration of an upholstered chair constructed in accordance with this aspect of the invention.

The actuator means preferably includes a single actuator for co-ordinated movement of both the seat and backrest sections, Preferably, the single actuator has a first range of movement for moving the backrest with respect to the seat section to provide the recliner function of the chair and a second range of movement for moving the seat section and backrest with respect to the base to provide the lift function of the chair.

This aspect of the present invention is particularly advantageous as only a single actuator, for example a powered motor, gas strut or spring, is required to provide both the lift and recline functions of the chair. This reduces the cost of the chair significantly compared with arrangements where two dedicated actuators are provided for the two separate functions of the chair. Thus there is a significant saving in manufacturing costs which affords wider appeal in the marketplace for the aforementioned type of lift-recliner chair.

Preferably, the first and second ranges of movement are contiguous. In this way the second range of movement immediately follows the first.

In preferred embodiments movement of the actuator means in the first range of movement exclusively moves the backrest with respect to the seat and base to provide the recliner function, and movement of the actuator means in the second range exclusively moves the seat and backrest with respect to the base to provide the said lift function. In this way there is a definite and immediate transition between recline and lift functions when the actuator is energised through its full range of movement, with the actuator acting either exclusively to recline the backrest or exclusively to lift the seat section.

Preferably, movement of the backrest with respect to the seat section is unfettered in the first range of movement. Movement of the backrest in the second range of movement is prevented by engagement of respective engagement parts of the backrest and seat sections. This provides a simple mechanical arrangement by which the two functions of the lift-recliner chair can be divided.

Preferably, the engagement parts engage by mutual abutment as the actuator means moves from the first range to the second range, and the engagement parts disengage as the actuator moves from the second range to the first. In this way engagement and disengagement is simply and conveniently effected at the transition between the first and second ranges of the actuator movement.

Preferably, at least part of the seat section is provided with a first engagement part which accommodates a second engagement part of the backrest, which second engagement part moves freely in the first engagement part through the said first range of movement and engages an abutment stop of the first engagement part at the transition between the said first and second ranges of movement. This provides a simple and compact arrangement for the purpose of providing both the lift and recline functions of the chair.

The backrest preferably includes a cross-member which extends between the said first engagement parts with the ends of the cross-member being provided with lever arms accommodated in the respective first engagement parts, said lever arms providing the said second engagement parts on both sides of the chair.

The actuator is a preferably a linear actuator. Actuator loads can be minimised by selective placement of a linear actuator to maximise the turning moment applied to the movable sections of the chair.

In preferred embodiments the actuator is connected at one end to the base and at the other end to the backrest. The actuator thus provides a connection between the base and the backrest and thereby supports a static load when the seat is raised.

The linear actuator maybe connected to the backrest cross-member. This readily enables actuator load to be applied first to the backrest in its first range of movement and then to the seat section, via engagement of the seat section with the backrest, in the second range of movement.

Preferably, the actuator means comprises a push only actuator.

In preferred embodiments, the chair further comprises a pair of armrests, preferably the armrests are fixed in relation to the base. This provides for fixed armrests which remain stationary when the chair is either raised or lowered. This can be particularly advantageous as a single sub-frame arm structure can be employed with the arm of the chair entirely integrated into the fixed base section, as compared with known arrangements where a split arm arrangement has been necessary.

Preferably, the seat section comprises a seat frame and the side members intersect the plane of the seat frame.

In preferred embodiments, the seat section comprises a seat frame and the side members extend in a forwards and downwards direction with respect to the frame.

Preferably, the elongate side members each comprise an arcuate member, the seat section comprises a seat frame and the side members extend in a forwards and downwards direction with respect to the frame, and a major part of the arcuate members extends below the plane of the frame with the concave side of the arcuate members facing forwards towards the front of the chair.

In preferred embodiments, the pivot axis of the seat section is defined by the centre of curvature of the said at least one guide and the elongate arcuate side members have a centre of curvature coincident with the pivot axis of the seat section.

According to another aspect of the invention there is provided a lift-recliner chair comprising a floor standing base section, movable seat and backrest sections and actuator means for moving the seat and backrest sections, the seat section being pivotally mounted with respect to the base section and the backrest being pivotally mounted with respect to the seat section, characterised in that the said actuator means includes a single push only actuator for co-ordinated movement of both the seat and backrest sections. Such an actuator provides inherent safety as a fully engaged driving force is only generated by the actuator in one direction. A driving force is generated in the reverse direction but immediately becomes disengaged if resistance is encountered, for example due to entrapment between the moving parts of the item of furniture. The lift-recline chair according to this aspect of the invention is particularly suited to this type of actuator as the fully engaged drive force is only required in one direction, that is to say in the direction that raises the seat section and/or the backrest.

BRIEF DESCRIPTION OF THE DRAWINGS

Various embodiments of the present invention will now be more particularly described, by way of example only, with reference to the accompanying drawings, in which.

DETAILED DESCRIPTION OF THE PREFERRED EMBODIMENTS

Figure 1:
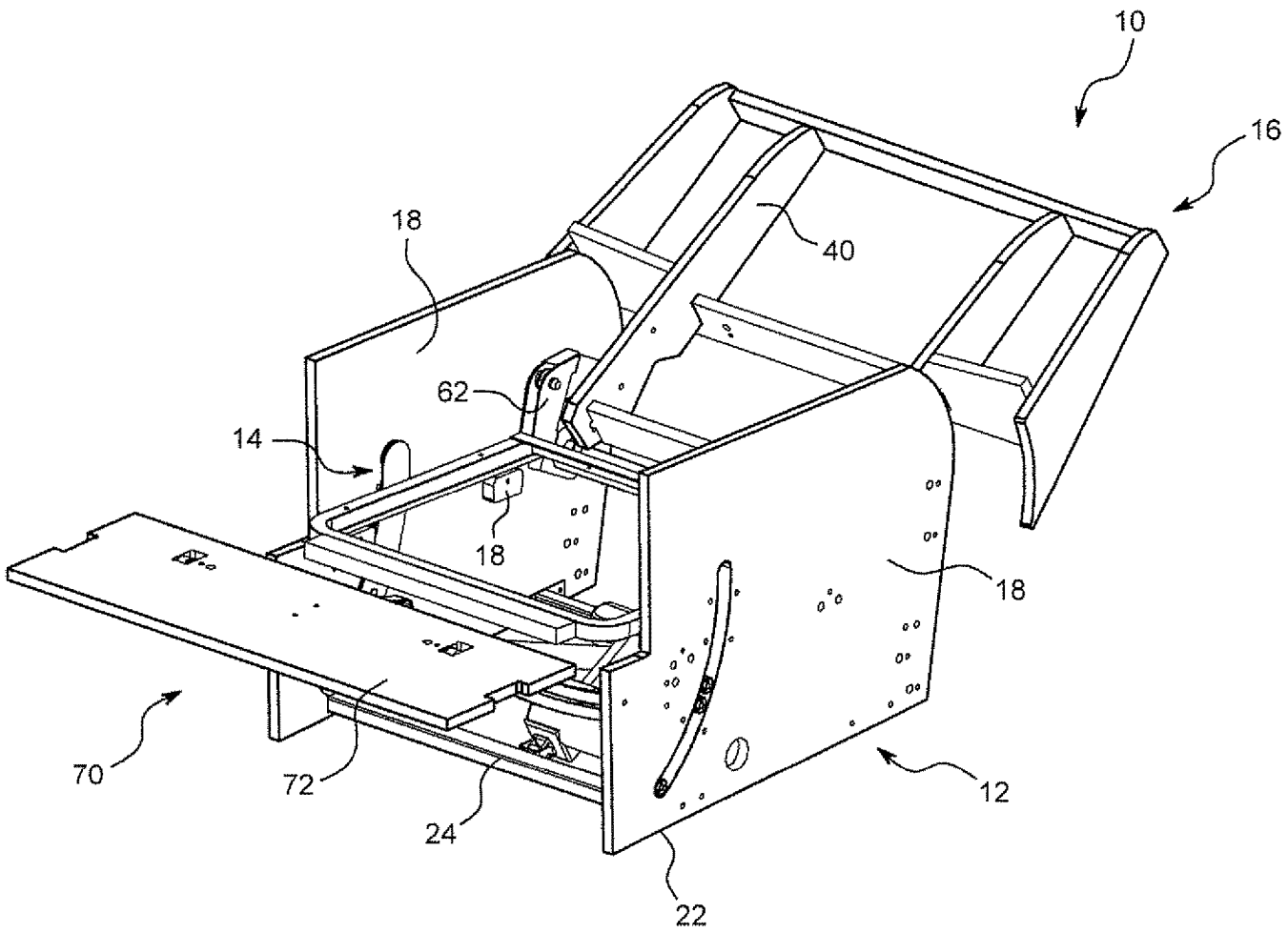
FIG. 1 is perspective view from the front of a lift-recliner chair frame according to an embodiment of the present invention, with the chair frame shown in a fully reclined position.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

In the drawings same reference numbers are used for same or similar parts throughout.

Referring now to FIGS. 1-19 which show the structural arrangement and moving parts of a lift-recliner chair arrangement according to an embodiment of the present invention.

In the drawings, FIGS. 1 to 12 and FIG. 17 are perspective views of the structural frame 10 of a lift-recliner chair according to an embodiment of the present invention. It is to be understood that the frame 10 constitutes the frame of a lift and recline chair before being upholstered. The frame is constructed principally from board material of the type typically used in the furniture industry, for example MDF or engineering board which is readily machinable on a CNC router or the like.

Figure 16:
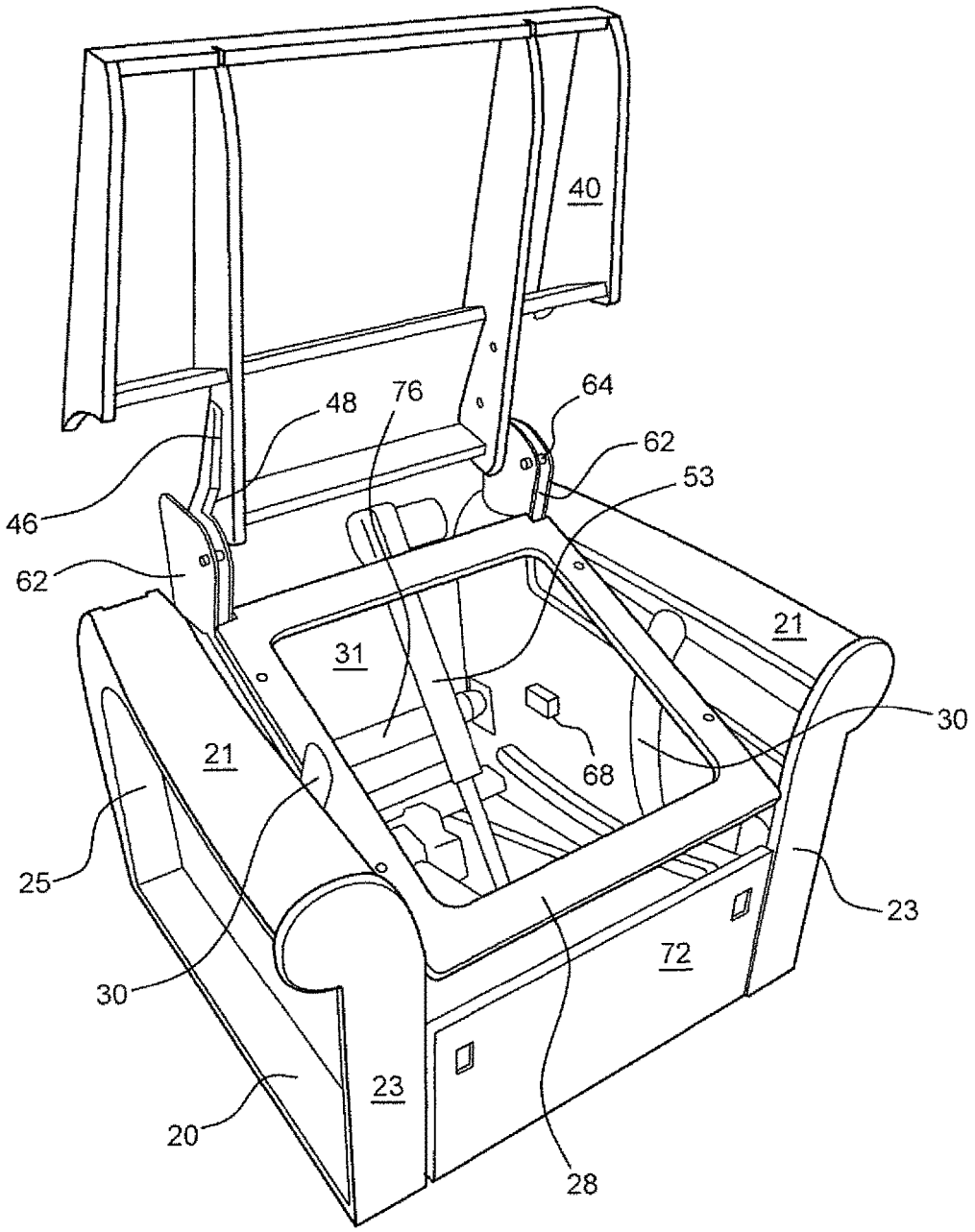
FIG. 16 is a perspective view of the chair of FIGS. 1 to 15 with the armrests shown.

The frame 10, and hence the chair, includes a base support section 12, a seat support section 14, and a backrest section 16. The base section includes a pair of lateral side panels 18 and a rear panel 31 (FIGS. 16, 17 and 18) extending between the side panels at the rear of the chair. The base section 12 constitutes the floor standing part of the chair and includes a pair of chassis legs in the form of elongate members 20 (see FIG. 16) which extend parallel to each other on the lateral (left and right hand) sides of the chair. The elongate members 20 are attached to the respective side panels 18 at the lower edges 22 thereof and extend outwards perpendicularly therefrom. The chassis legs 20 constitute floor support members to which castors, support feet or the like may be attached for contact with the floor on which the chair stands. The chassis legs are preferably constructed from the same board material as the rest of the frame 10. As shown in FIG. 16, arm rests in the form of profiled elongate members 21 are attached to the respective side panels 18 at the upper edges thereof and extend perpendicularly outwards therefrom. The armrests 21 constitute part of an arm rest frame and combine with the elongate members 20 and front and rear closure panels 23 and 25 to provide an armrest sub-frame structure on respective sides of the chair. The sub-frame structure has the shape of a conventional armrest of an upholstered chair.

Figure 7:
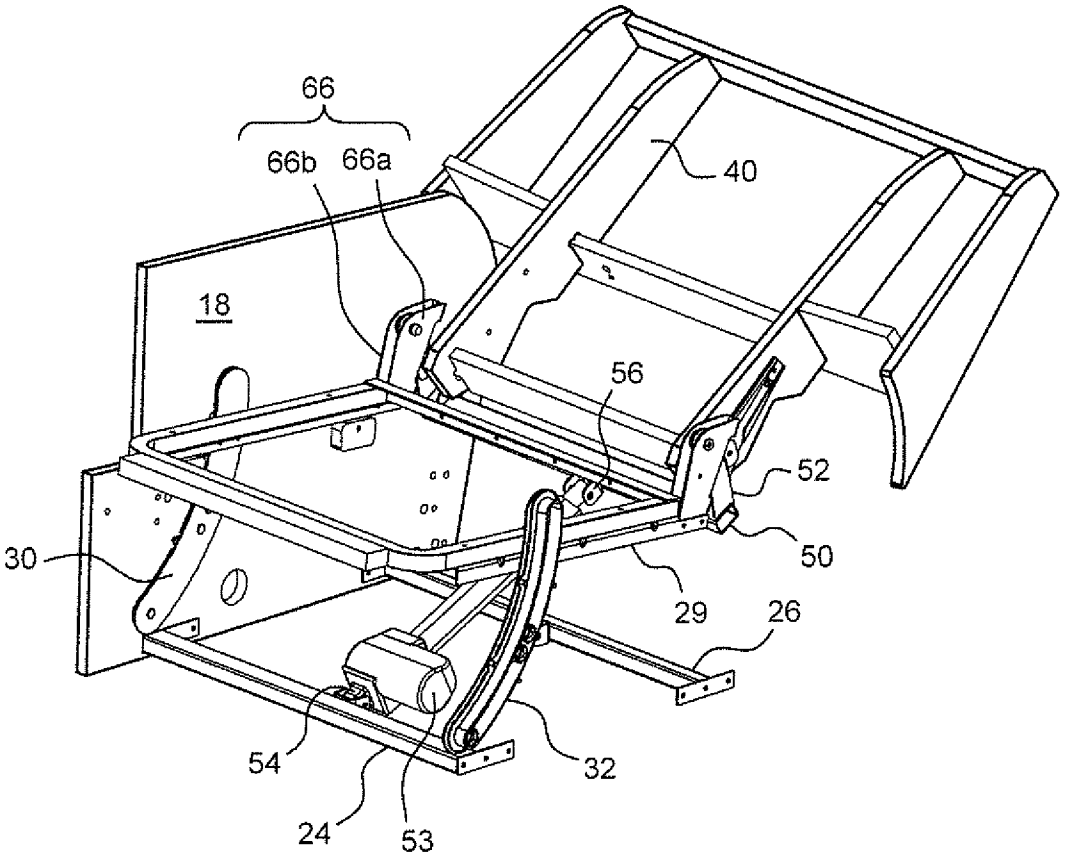
FIG. 7 is perspective view identical to FIG. 1 with the base section left hand side panel and foot rest omitted for illustrative purposes only.
Figure 8:
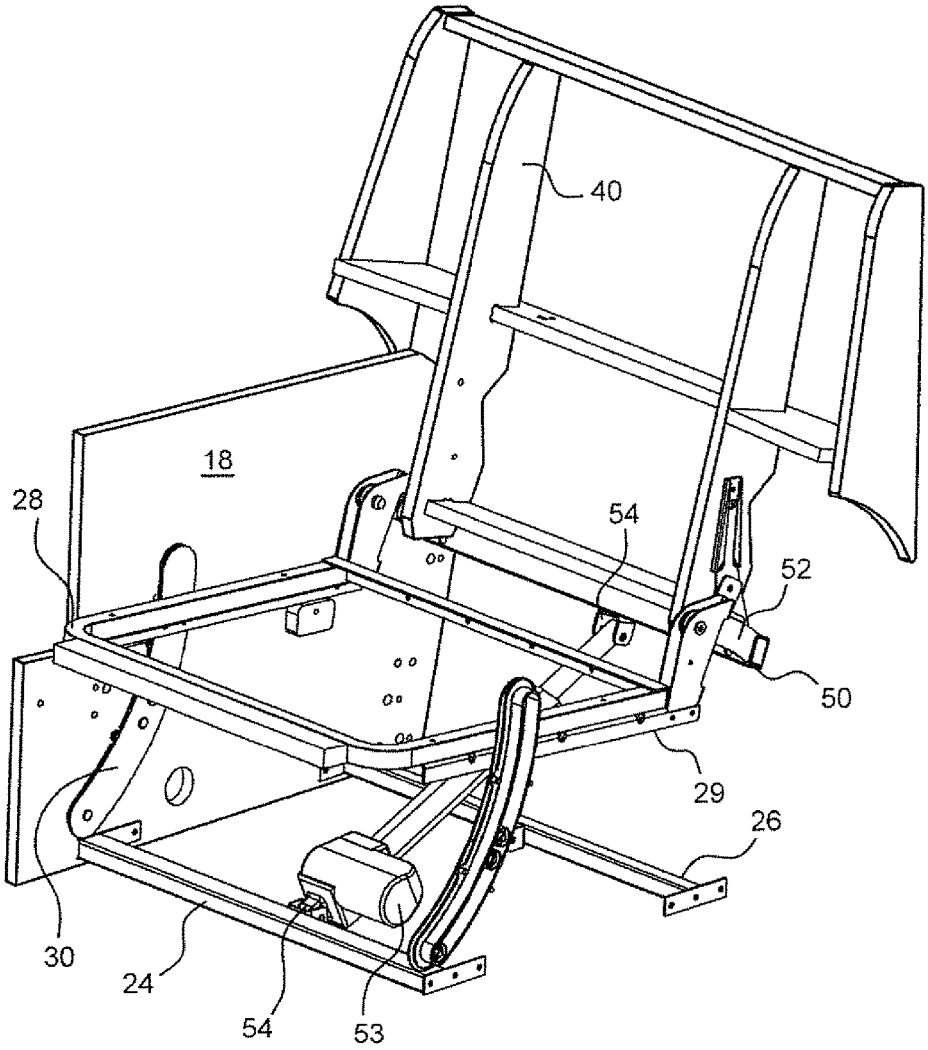
FIG. 8 is perspective view identical to FIG. 2 with the base section left hand side panel and foot rest omitted.
Figure 9:
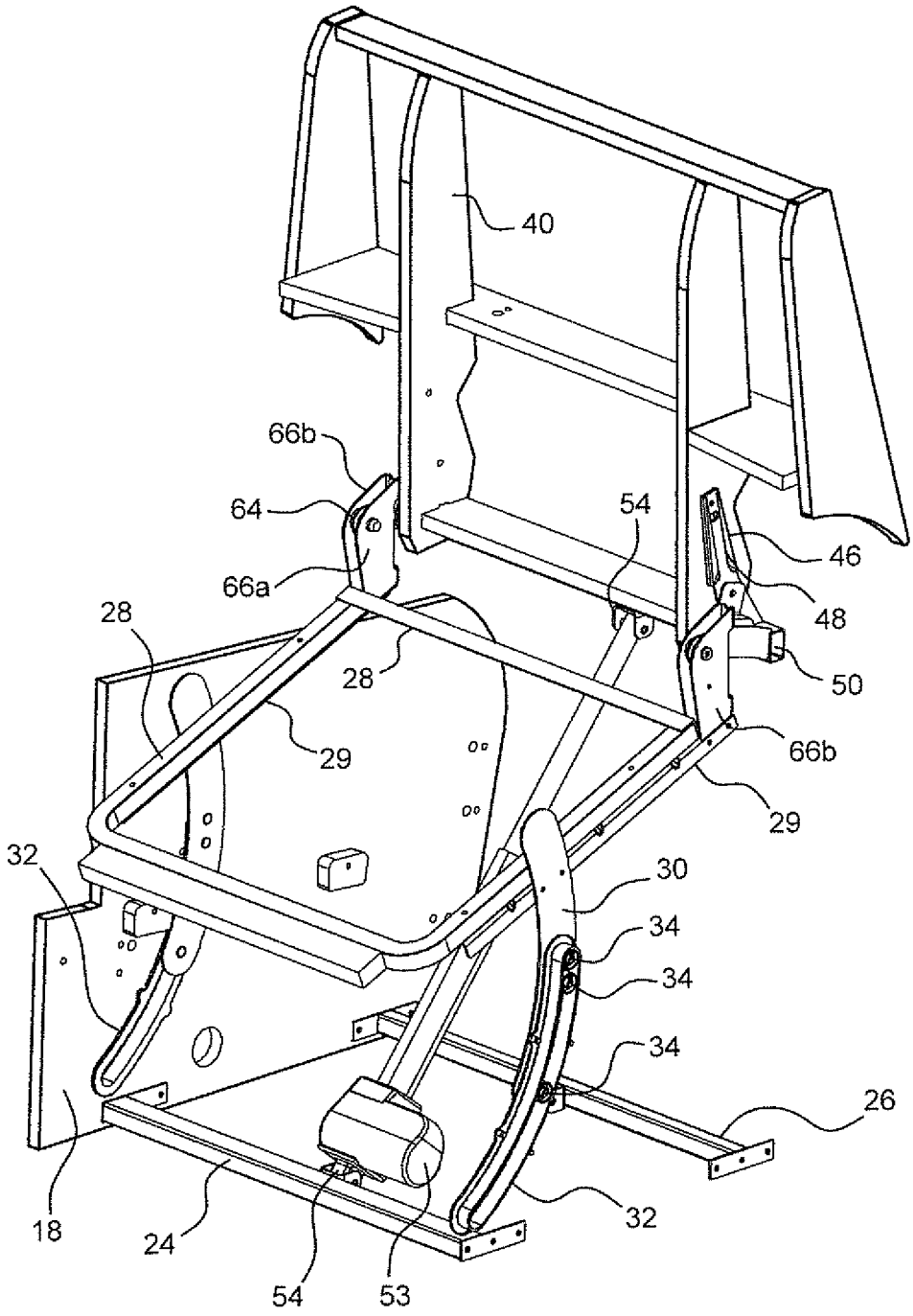
FIG. 9 is perspective view identical to FIG. 3 with the base section left hand side panel and foot rest omitted.
Figure 10:
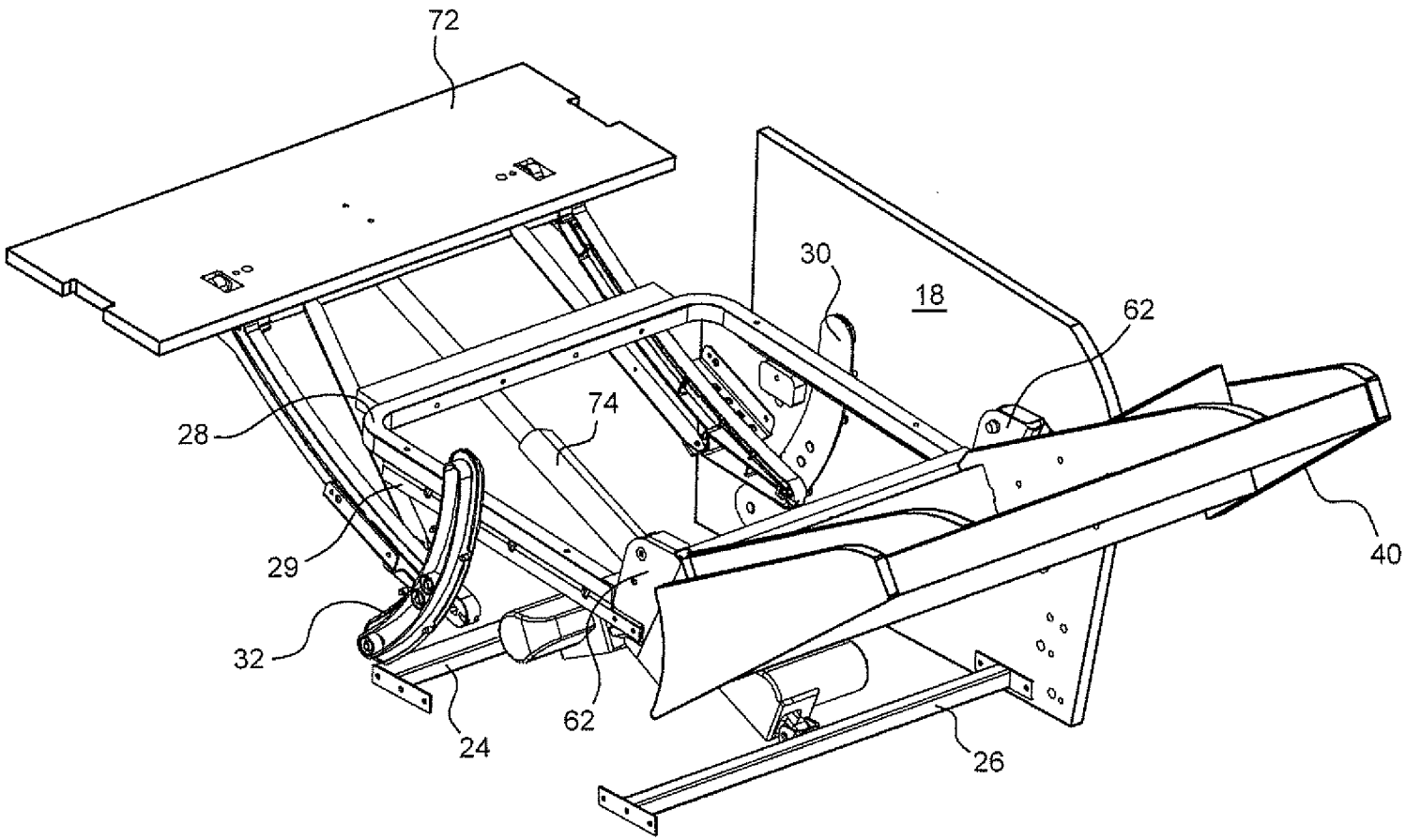
FIG. 10 is perspective view from the rear of the lift-recliner chair frame shown in FIG. 1 with the base section left hand side panel omitted.
Figure 11:
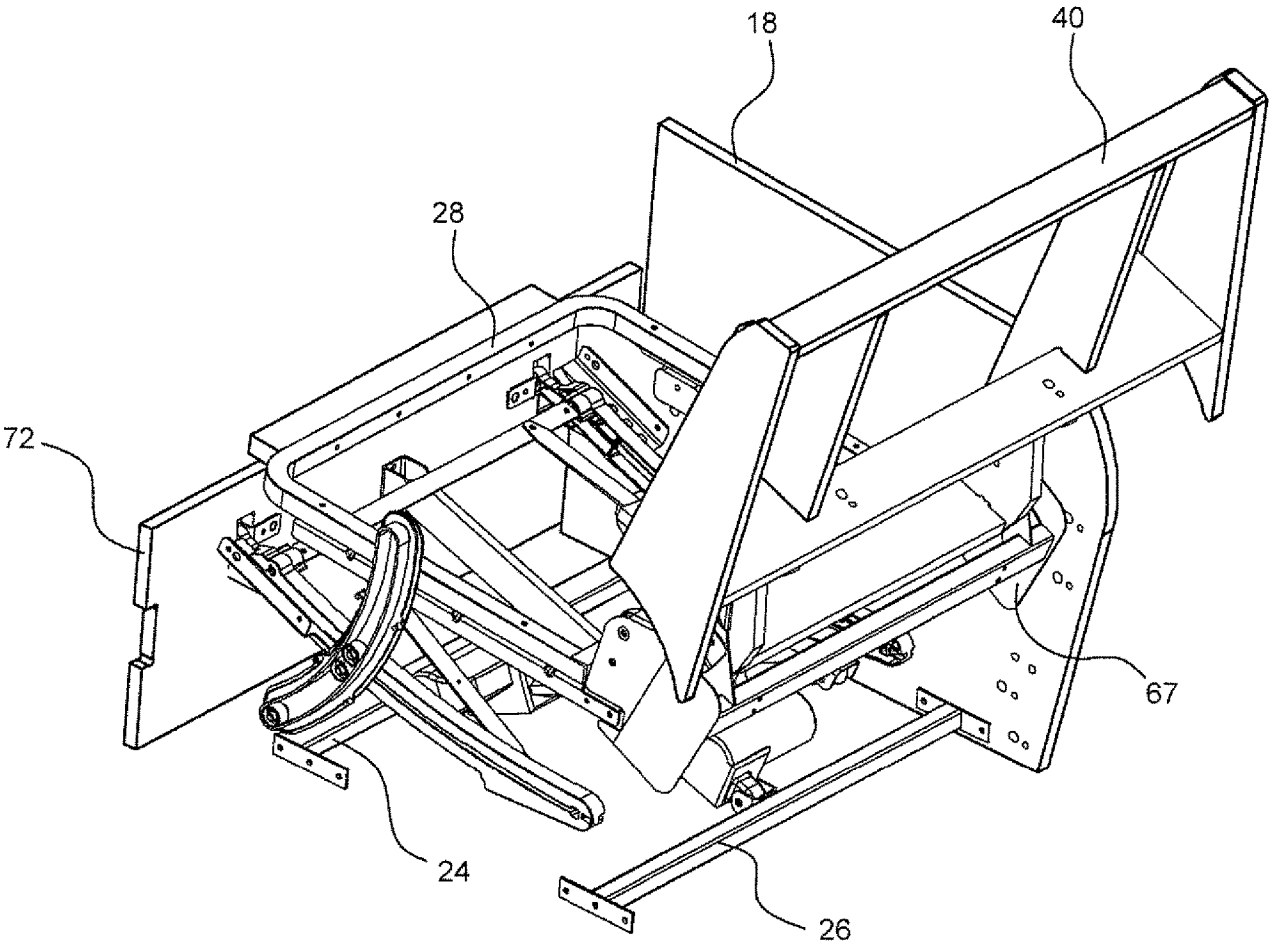
FIG. 11 is perspective view from the rear of the lift-recliner chair frame shown in FIG. 1 with the base section left hand side panel omitted and the chair in the upright configuration of FIG. 2.
Figure 12:
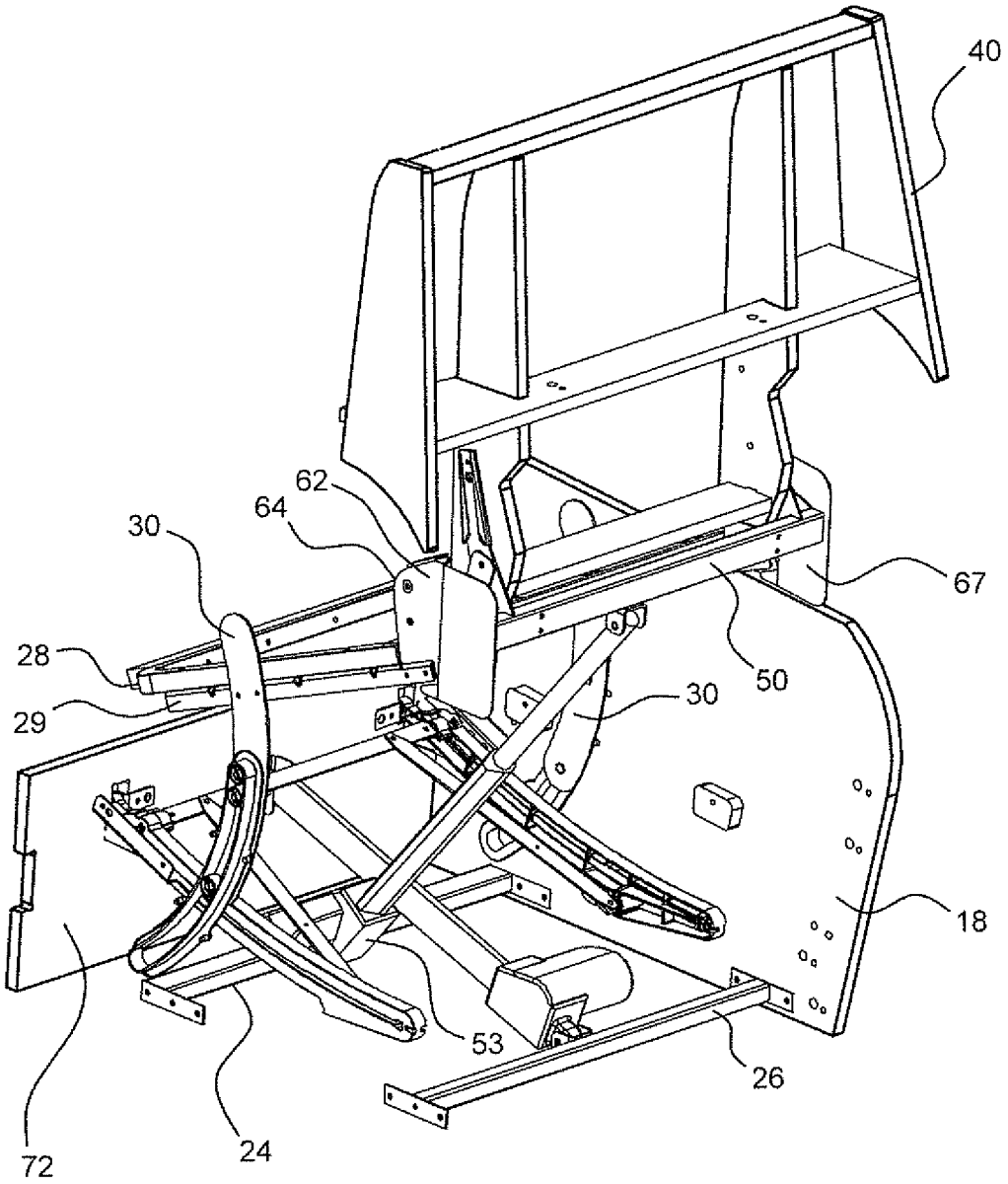
FIG. 12 is perspective view from the rear of the lift-recliner chair frame shown in FIG. 1 with the base section left hand side panel omitted and the chair in the raised configuration of FIG. 3.
Figure 13:
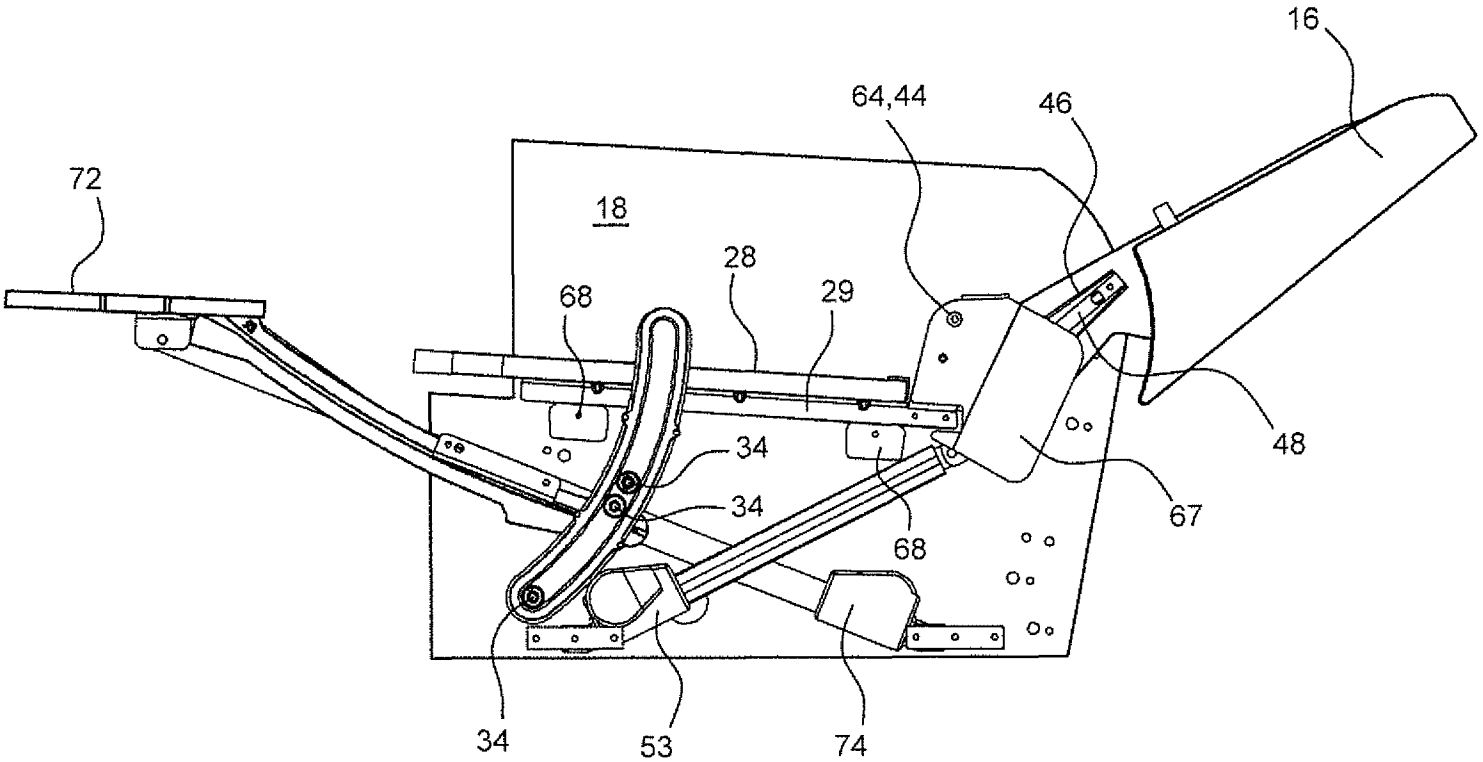
FIG. 13 is a side view of the chair of FIG. 1 with the base section left hand side panel omitted with the chair in the reclined configuration of FIG. 1.
Figure 14:
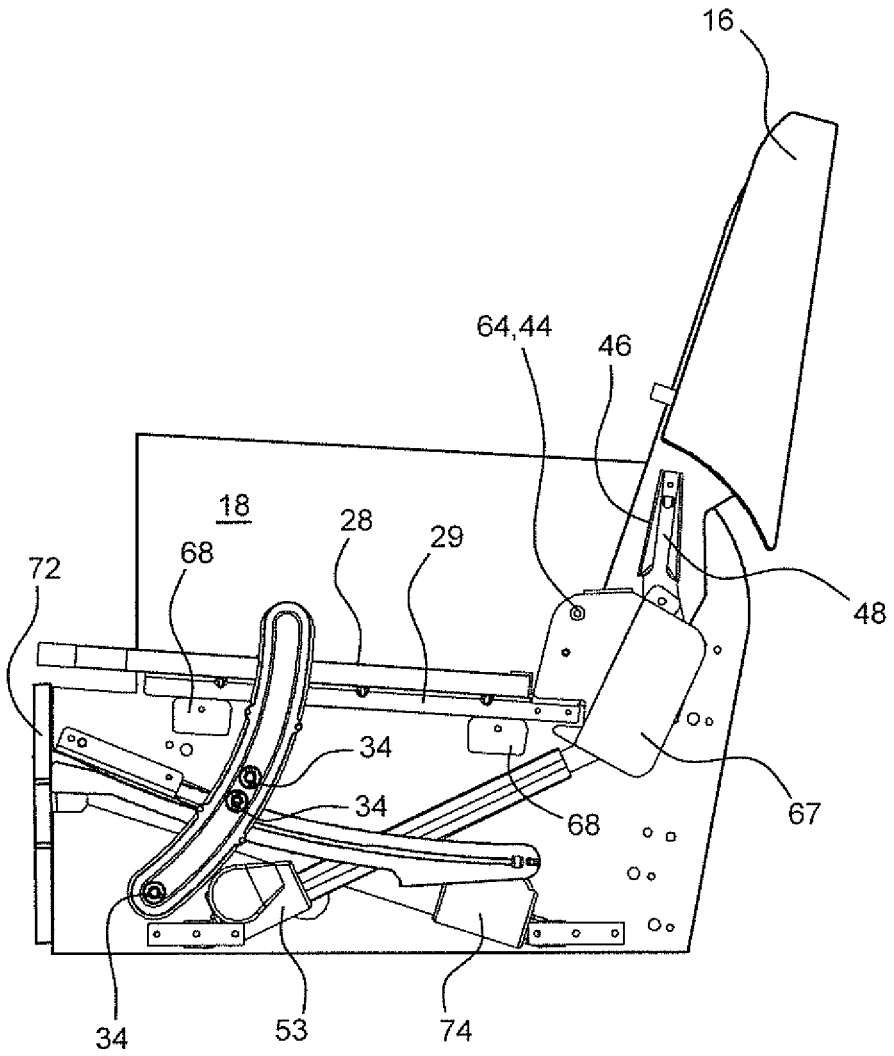
FIG. 14 is a side view of the chair of FIG. 1 with the base section left hand side panel omitted with the chair in the upright configuration of FIG. 2.
Figure 15:
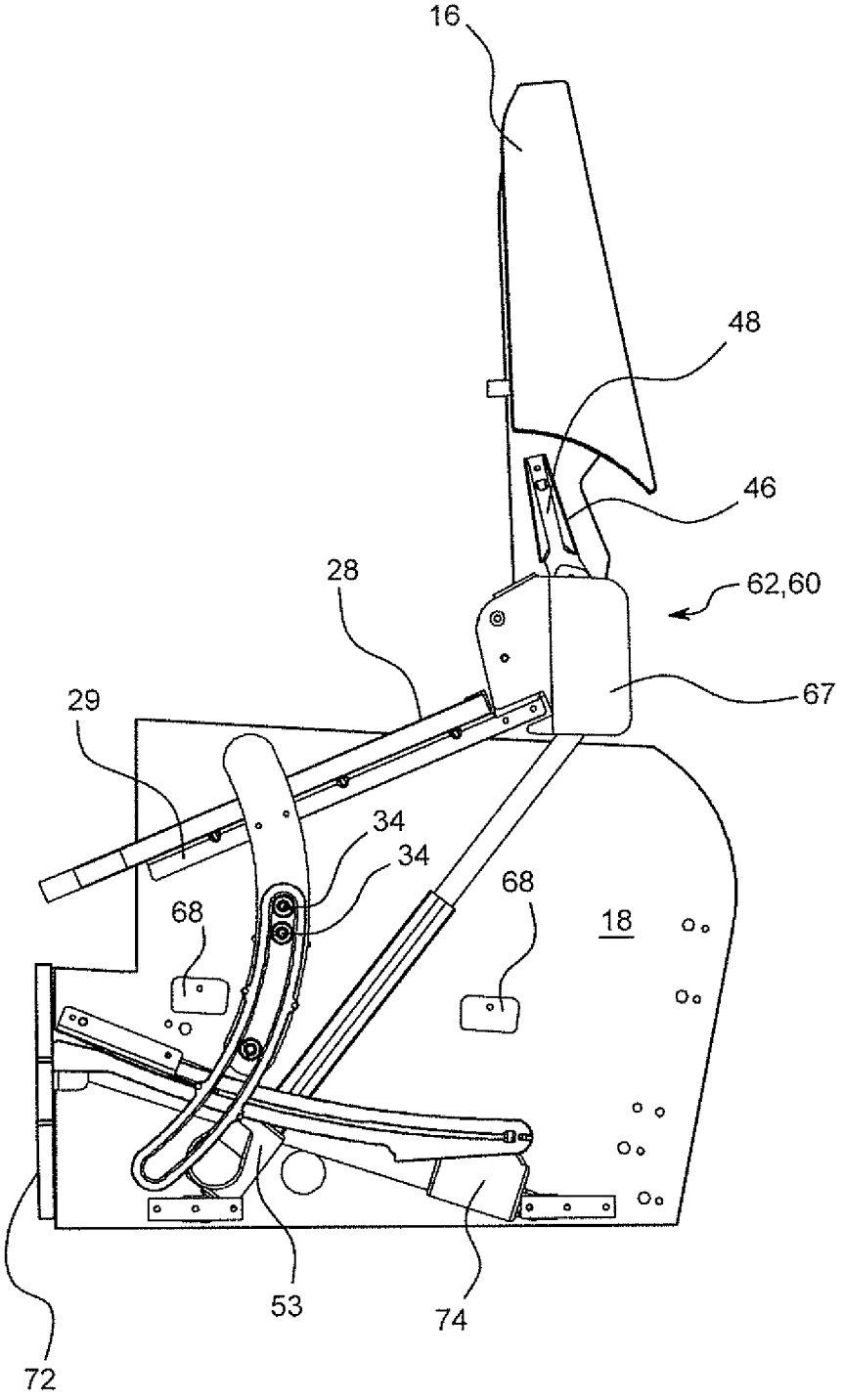
FIG. 15 is a side view of the chair of FIG. 1 with the base section left hand side panel omitted with the chair in the raised configuration of FIG. 3.

The side panels 18 are connected together at the front and rear of the chair by front and rear cross-members 24 and 26 which extend between the panels in the region of the panel bottom edges 22, as can best be seen in FIGS. 7-9. The cross-members 24 and 26 are of tubular metal construction and are provided with perpendicular mounting flanges 27 for attachment to the respective side panels 18, typically by means of suitable fasteners such as screws or the like.

The side panels 18, rear panel 31 (FIG. 16), elongate chassis legs 20 and cross-members 24, 26 define an outer open box like structure for supporting the other parts of the chair.

The seat section 14 comprises a support structure constructed primarily of board material and comprises a generally rectangular hollow frame 28 and a pair of arcuate elongate downwardly depending lateral side members 30. The seat frame 28 supports the seat pad (not shown) of the chair in a manner well known to those skilled in the art. The elongate lateral side members are preferably of planar metal sheet construction. The lateral sides of the frame 28 are connected to metal reinforcement members 29 that extend from front to back along the lateral sides of the frame 28. The reinforcement members 29 are connected to the frame 28 by suitable fixings such as screw fixings or the like and are further connected to, or integrally formed with, the respective arcuate lateral side members 30, which intersect the plane of the frame 28 extending in a forwards and downwards direction with respect to the frame 28. The major part of the arcuate members extends below the plane of the frame 28 with the concave side of the arcuate members facing forwards towards the front of the chair.

The seat section 14 locates within the base section 12 between the side panels 18 and is pivotally connected thereto by a series of guides and followers in a similar manner to the arrangements disclosed in WO2005/132481, the contents of which are incorporated herein by reference. Arcuate guide slot inserts 32 are provided in corresponding slots in the panels 18. The guide slot inserts 32 are preferably of nylon or other suitable polymeric material. The guide slots 32 each receive three spaced followers in the form of rollers 34 rotatably mounted on adjacent seat section arcuate side members 30. The rollers are positioned on the outward facing side of the elongate side members. The rollers are free to run in the guide slots 32 to provide angular adjustment of the seat position.

The pivot axis of the seat section is defined by the centre of curvature of the slots 32. The elongate arcuate side members 30 of the seat section have a centre of curvature coincident with the centre of curvature of the slots 32 and hence the pivot axis of the seat section. In the present embodiment, the elongate side members are contained entirely within the space envelope defined by the side panels 18 in all adjustment positions of the chair, that is to say they do not project above the top edges of the respective side panels when the seat section is fully raised and the side members fully extended. The amount of adjustment is determined by the extent of travel of the rollers 34 in the circumferential slots 32. This can be readily determined from the side view drawings of FIGS. 13 and 15 where respective rollers 34 limit the adjustment of the seat section with respect to the base section by abutment with respective ends of the slots, at both extreme ends of travel at the raised and lowered configurations of the chair. As can best be seen in the drawings of FIGS. 13 and 14 the elongate side members 30 are approximately the same size and shape as the slots 32. In the lowered position of the chair the elongate side members occupy substantially the same position as the slots 32 when viewed side on as in the side elevation views of FIGS. 13 and 14.

It will be understood that the width dimension of the seat section is slightly less than the width dimension of the base section between the side panels 18, so that the seat section locates within the base section and is extendable thereform when pivoted about its pivot axis to the raised position shown in FIGS. 3, 6, 9, 12 and 15. In this respect the base section may be considered to comprise an outer frame of the chair, complete with arm rests (as seen in FIG. 16 only), and the seat section an inner frame which is movable within the fixed frame of the base. The present invention also contemplates embodiments where the seat section forms an outer frame and the base section an inner frame of the chair, as described in more detail below, by way of example only, with respect to the chair shown in the drawings of FIGS. 19 to 21.

The seat section is provided with a pair of brackets 62 at the rear corners of the frame 28. The purpose of the brackets is significant to the function of the illustrated embodiment of the present invention and will be discussed in more detail below, in relation to the operation of the backrest 16 and the lifting function of the chair.

The backrest 16 is constructed as a separate knock down component in the form of a structural frame. The backrest comprises a removable, generally rectangular shaped, frame 40 which is attached to connecting parts 42 of a pivot mounting arrangement 60 which pivotally connects the backrest to the seat section at pivot 44. The removable frame 40 is typical of a removable knock down backrest used in the upholstered furniture industry for recliner chairs having female connecting parts 46 which receive corresponding male connecting parts of brackets 48 of the pivot mounting arrangement 60.

The pivot mounting arrangement 60 is preferably of metal construction and comprises: a tubular cross-member 50 which extends across the width of the chair at the bottom of the backrest frame 40, with ends of the cross-member 50 disposed on respective lateral sides of the chair; a pair of pivot mounting brackets 62 disposed at the rear of the seat frame 22 at respective left and right hand rear corners thereof; a pair of lever arms 52 which extend from the respective ends of the cross member 50 to the pivot 44 where they are mounted on respective pivot pins 64 carried by the respective brackets 62. The brackets 62 are fixed to the reinforcement members 29 of the seat frame 28 by welding or other means. The brackets 62 each comprise a pair of parallel side plates 66*a*, 66*b* which are spaced apart to accommodate the distal end of the lever arm. Sufficient clearance is provided between the side plates 66*a*, 66*b* for the lever arms to move freely on the respective pivot pins which extend between the respective side plates 66*a*, 66*b*.

Figure 2:
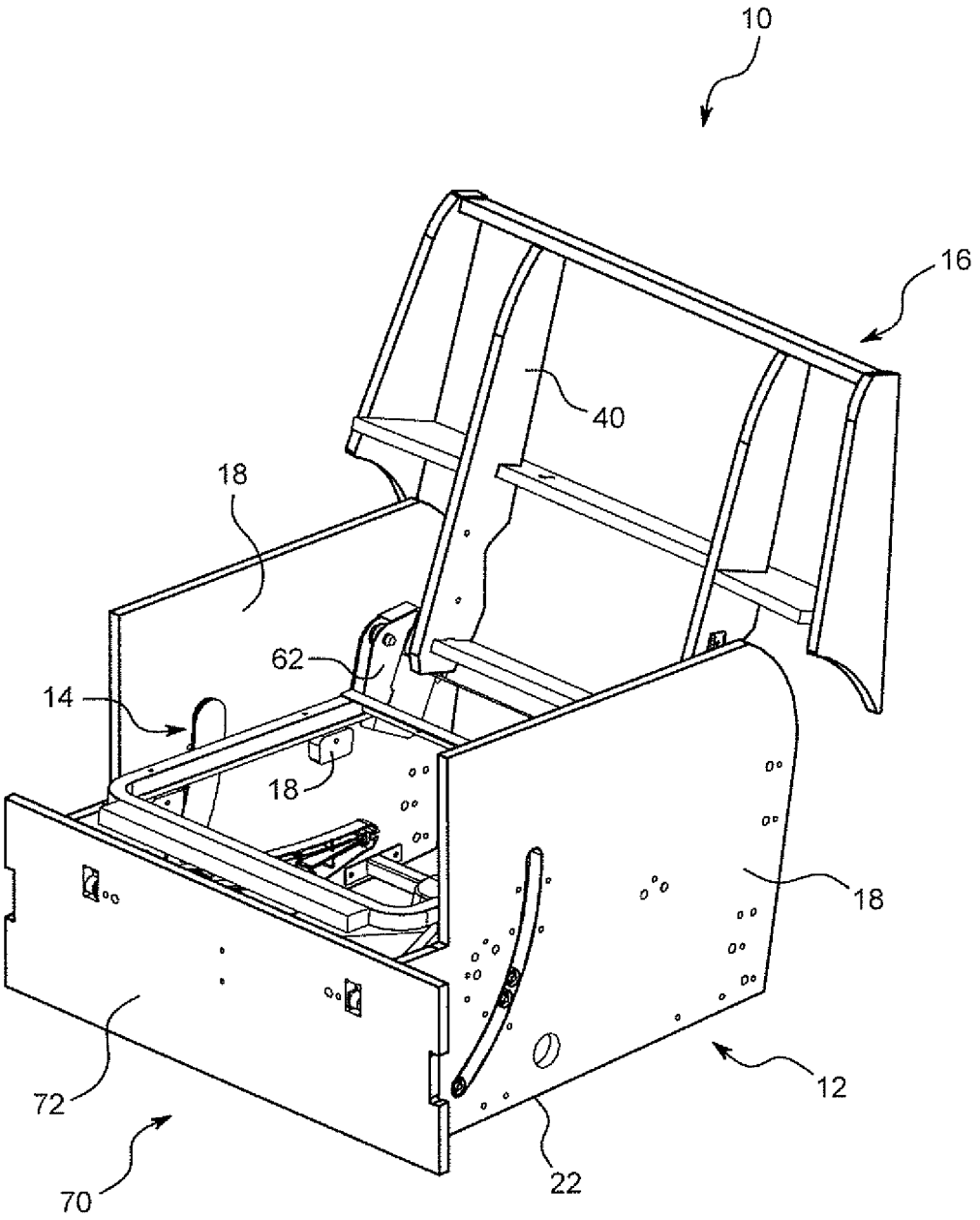
FIG. 2 is a perspective view similar to FIG. 1 with the chair frame shown in an upright position.

The top of each bracket 62 is closed at the rear, or partially closed, between the plates 66*a*, 66*b* to create an abutment stop to limit the extent of upwards pivotal movement of the lever arms in the brackets by engagement with the abutment part of the brackets when the backrest is returned to its upright position of FIG. 2. This occurs when the backrest is moved to its maximum raised position relative to the seat section (FIGS. 3, 6, 9 12 and 15) as will be explained in greater detail below. The brackets 62 are each provided with a further metal plate 67 which projects rearwards of the brackets 66*b* to provide additional shielding of possible entrapment points in the region of the brackets between the seat and backrest sections.

As can best be seen in the drawing of FIGS. 8 and 9, the connecting brackets 48 are positioned slightly inboard of the levers 52 on the cross-member 50. The cross-member 50, lever arms 52 and connecting brackets 48 thus form a rigid integral structure and are preferably of metal construction joined together by welding.

An electrical linear actuator (jack) 53, as shown in the drawings of FIGS. 1 to 9 is connected between the base section cross-member 24 and the backrest section cross-member 50. The linear actuator is connected at one end to mounting bracket 54 midway along the cross-member 24 and connected at the other end to mounting bracket 56 midway along the cross-member 50 such that extension and retraction of the actuator causes the backrest to be pivoted about its pivot axis 44 and the seat section to be lifted or lowered.

In the drawings of FIGS. 3, 6, 9 and 15 the chair is fully raised to its lift position. In this position the single linear actuator 53 is at full extension. In this position the ends of the lever arms 52 abut the respective abutment stop of the brackets 62. As the actuator is retracted the seat section is lowered as it moves about its pivot axis until the seat section frame 28 contacts an abutment stop 68 on each of the inward facing surfaces of the side panels 18 which prevents further movement of the seat section with respect to the base. Further retraction of the linear actuator effects movement of the backrest about its pivot axis 44 to recline the backrest with respect to the base and seat section to the fully reclined position, as shown in FIGS. 1, 4, 7 and 13. As the actuator is retracted from the intermediate position where the backrest is upright, the arms 52 disengage from the respective abutment stops on the brackets 62.

It will be understood that the actuator has two ranges of movement, first from a fully retracted position where the backrest is fully reclined, as shown in FIGS. 1, 4, 7 and 13, to an intermediate extension position where the backrest is moved to an upright position by movement of the arms 52 to their abutment position as shown in FIGS. 2, 5, 8, and 14, and a second range of movement from the aforementioned intermediate position to a fully extended position which causes the seat section to rotate about its pivot axis due to abutting engagement of the arms 52 with the aforementioned abutments stops of the respective brackets 62 from the intermediate extension position onwards. Thus, the linear actuator connected between the cross-member mounting brackets 54 and 56 provides the necessary force, and hence motion, for moving the backrest with respect to the seat and base sections to provide the recliner function, and subsequently to move the backrest and seat section with respect to the base section to provide the lift function of the chair.

In preferred embodiments the actuator 53 is an electrical linear actuator of the push only type, that is to say a linear actuator having a fully engaged drive in one direction only, for example and actuator such as the push only versions of the Alphadrive, Betadrive or Deltadrive linear actuators by DewertOkin. It will be understood that such an actuator provides inherent safety as a fully engaged driving force is only generated by the actuator in one direction. The lift chair described above is particularly suited to this type of actuator as the full drive force is only required in one direction. When the backrest and/or seat section is raised a push force is required as the actuator is extended to raise the chair and the weight carried by the chair. An actuator configured to provide both a push and pull force could result in crushing forces being applied to an obstruction caught between the moveable parts or sections of the chair when the actuator is retracted to lower the chair. This possibility is avoided with a push only actuator as any obstruction would only be subject to the weight of the chair and any external weight carried by the chair when the actuator is retracted. This is because in a push only actuator the drive force is immediately disengaged if an obstruction is encountered. Thus, the possibility of a crushing force being developed by the actuator is avoided when actuator 53 is of the push only type.

The chair shown in FIGS. 1 to 18 also comprises a moveable footrest section 70 having a footrest board 72 moveable between a lowered position (FIGS. 2, 3, 5, 6, 11, 12, 14, 15, 17 and 18) in which the foot board lies vertically, providing a front closure panel at the front of the chair, and a raised horizontal position (FIGS. 1, 4, 10 and 13). The footrest 70 is provided with a dedicated linear actuator 74, independent of actuator 53, for moving the footrest board between the aforementioned positions as is well known to those skilled in the art. Actuator 74 could also be of the push only type if required.

Figure 17:
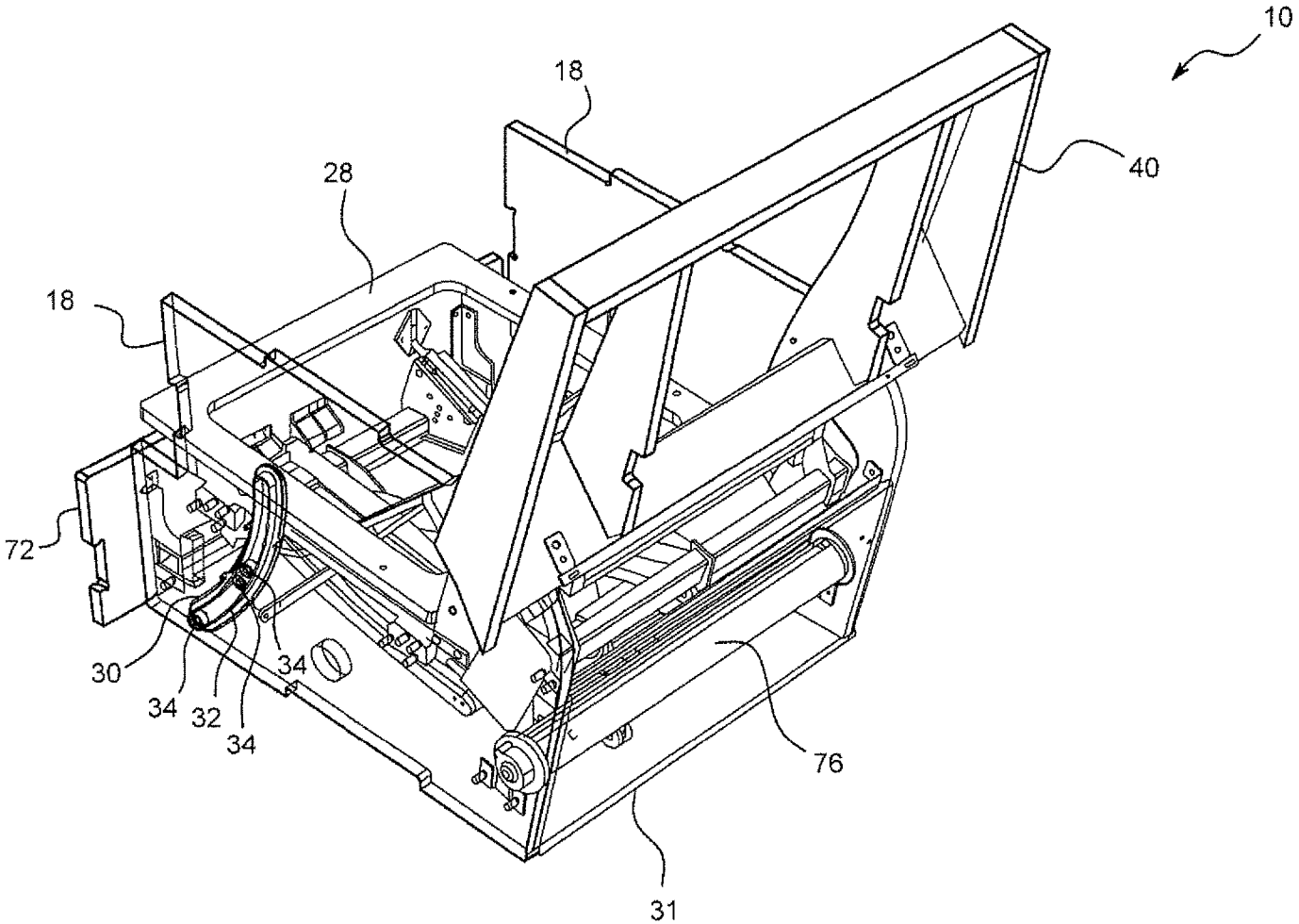
FIG. 17 is perspective view similar to FIG. 11 with the chair having a rear panel and roller blind arrangement, the base section left hand side panel and rear panel of the chair indicated in transparent ghost outline.
Figure 18:
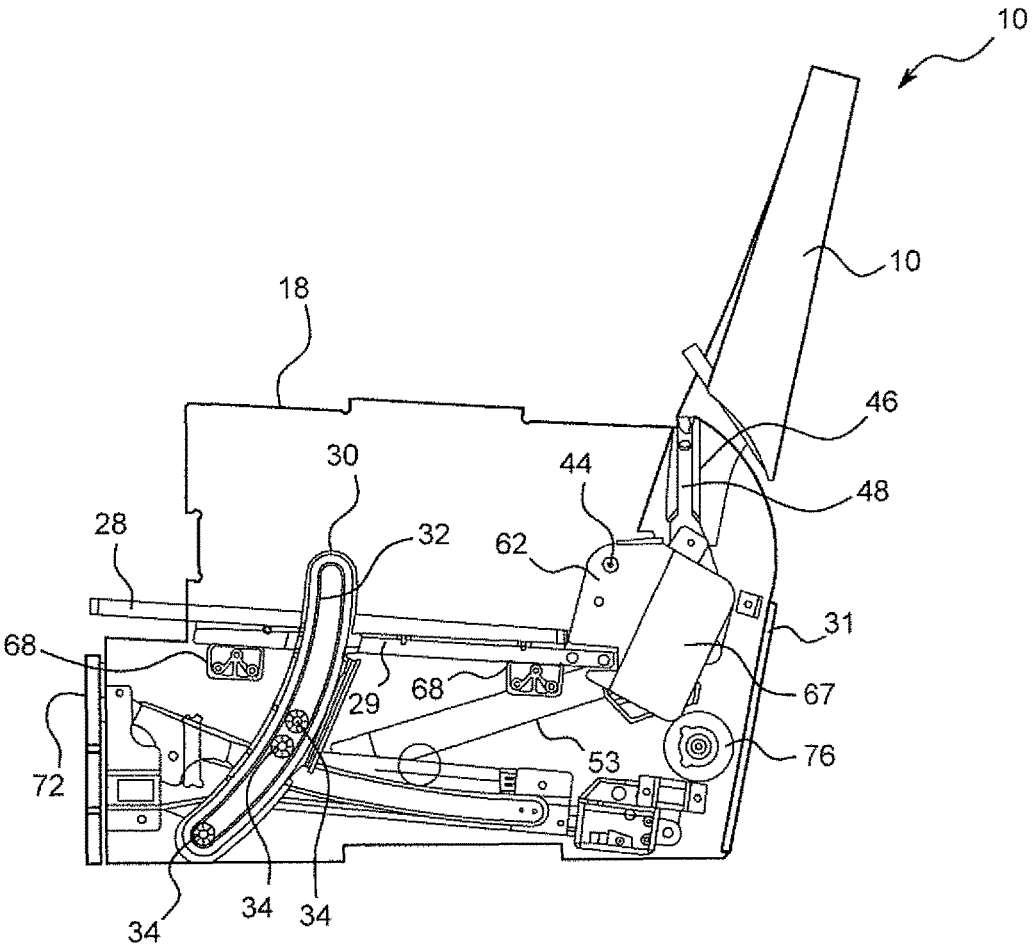
FIG. 18 is a side view of the chair of FIG. 17 with the base section left hand side panel of the chair indicated in transparent ghost outline, with the chair in the upright configuration of FIG. 2.

Referring now to FIGS. 17 and 18, in preferred embodiments the rear of the base is closed between the top of the rear panel 31 and the lower end of the backrest by a fabric roller blind (not shown) wound on a spindle 76 secured between the side panels 18 behind the rear panel 31 in the interior region of the chair. For the purpose of illustration only, the left hand side panel 18 and the rear panel 31 are shown in transparent ghost outline in the drawings of FIGS. 17 and 18 in order to show the interior detail of the chair including the spindle 76.

Figure 3:
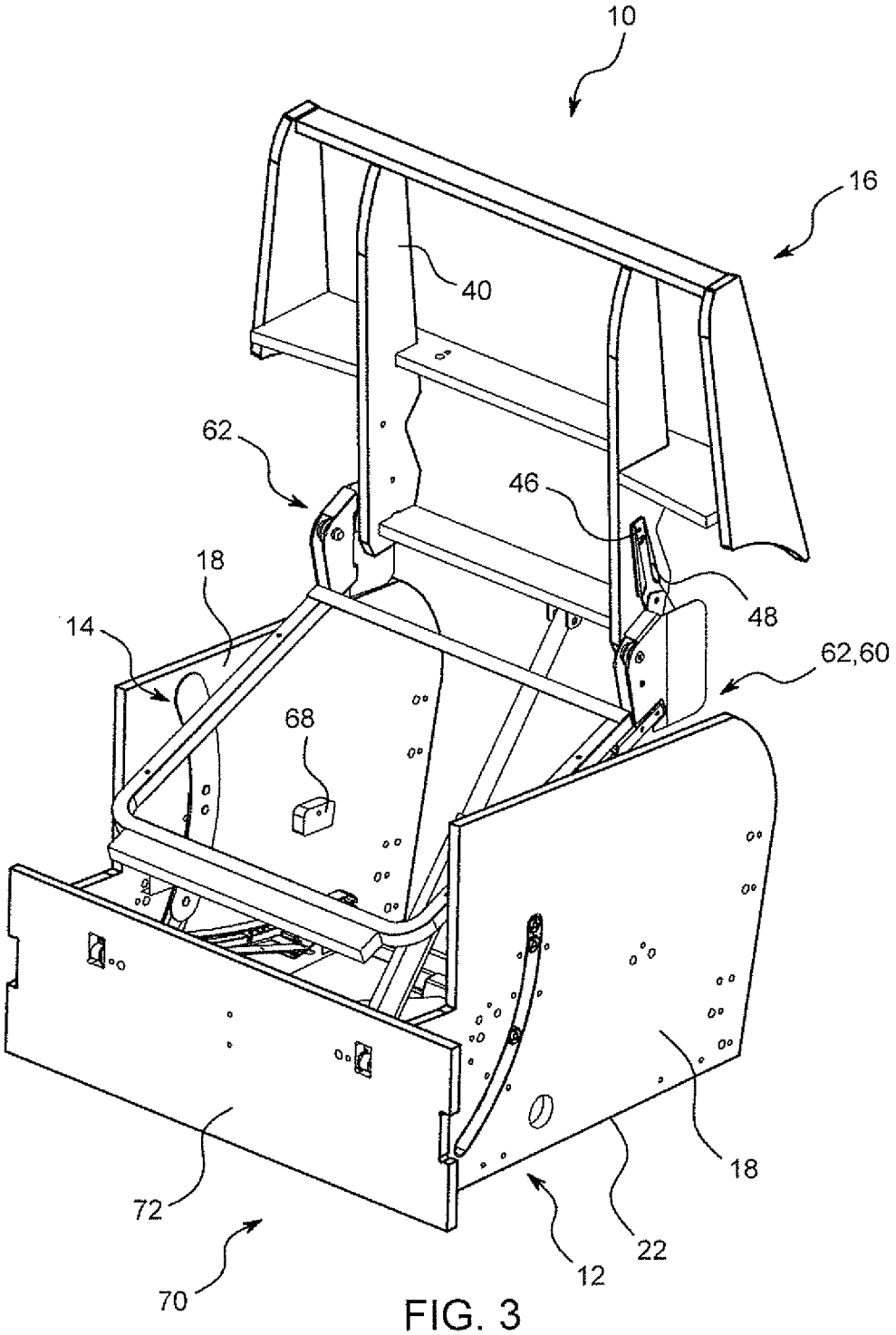
FIG. 3 is a perspective view similar to FIGS. 1 and 2 with the chair frame shown in a fully raised position.
Figure 4:
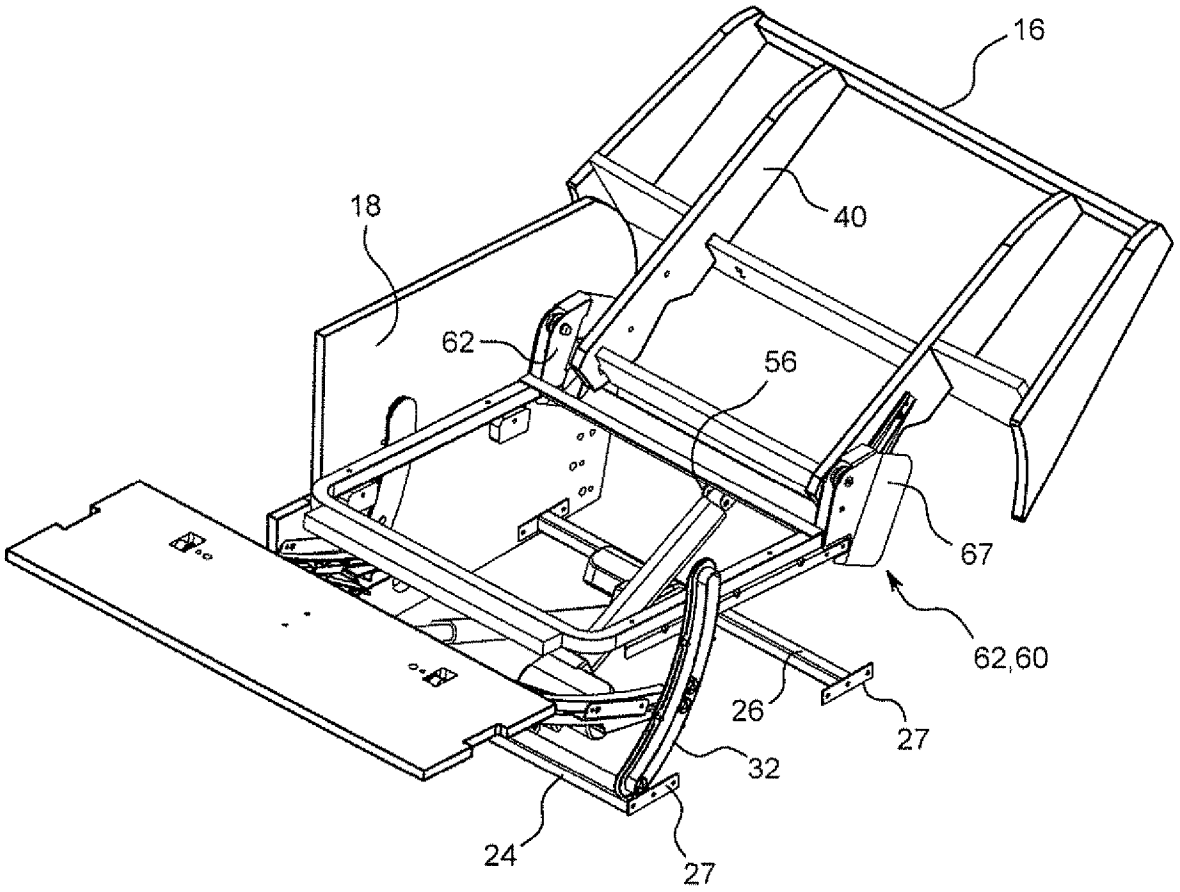
FIG. 4 is perspective view identical to FIG. 1 with the base section left hand side panel omitted for illustrative purposes only.
Figure 5:
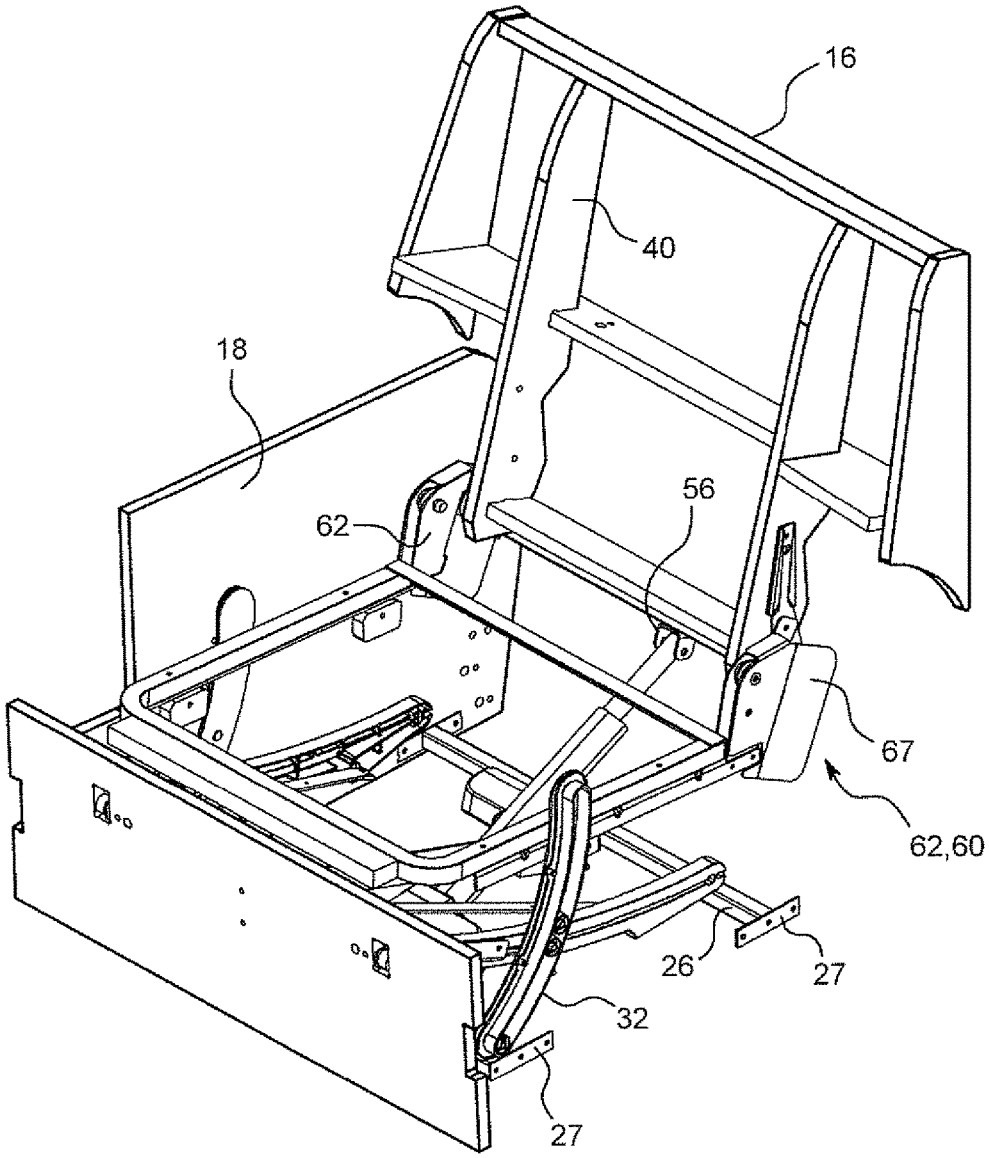
FIG. 5 is perspective view identical to FIG. 2 with the base section left hand side panel omitted.
Figure 6:
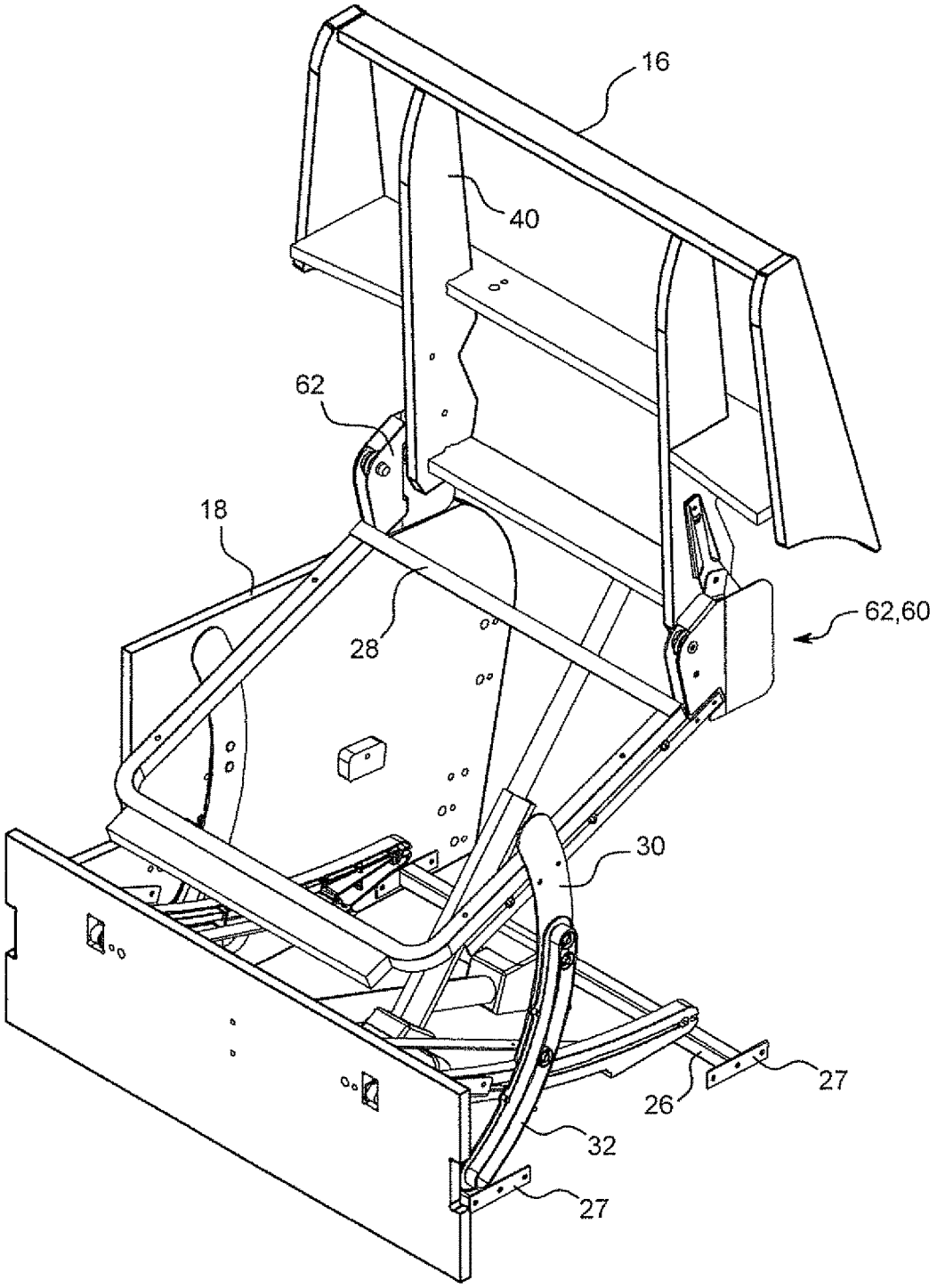
FIG. 6 is perspective view identical to FIG. 3 with the base section left hand side panel omitted.

It will be understood, that as the chair moves from its upright position of FIG. 2 to the raised position of FIG. 3 the roller blind deploys by unwinding from the spindle 76, on which it is mounted, by the action of the moving backrest pulling the free end of the blind, which is attached to the backrest, deploying the blind from the spindle 76 to maintain a barrier between the backrest and the base of the chair. In this respect. It will be understood that the fabric of the roller blind closes the gap at the rear of the chair that would otherwise occur as the chair is raised, with the roller blind being wound in when the backrest is lowered.

Figure 19:
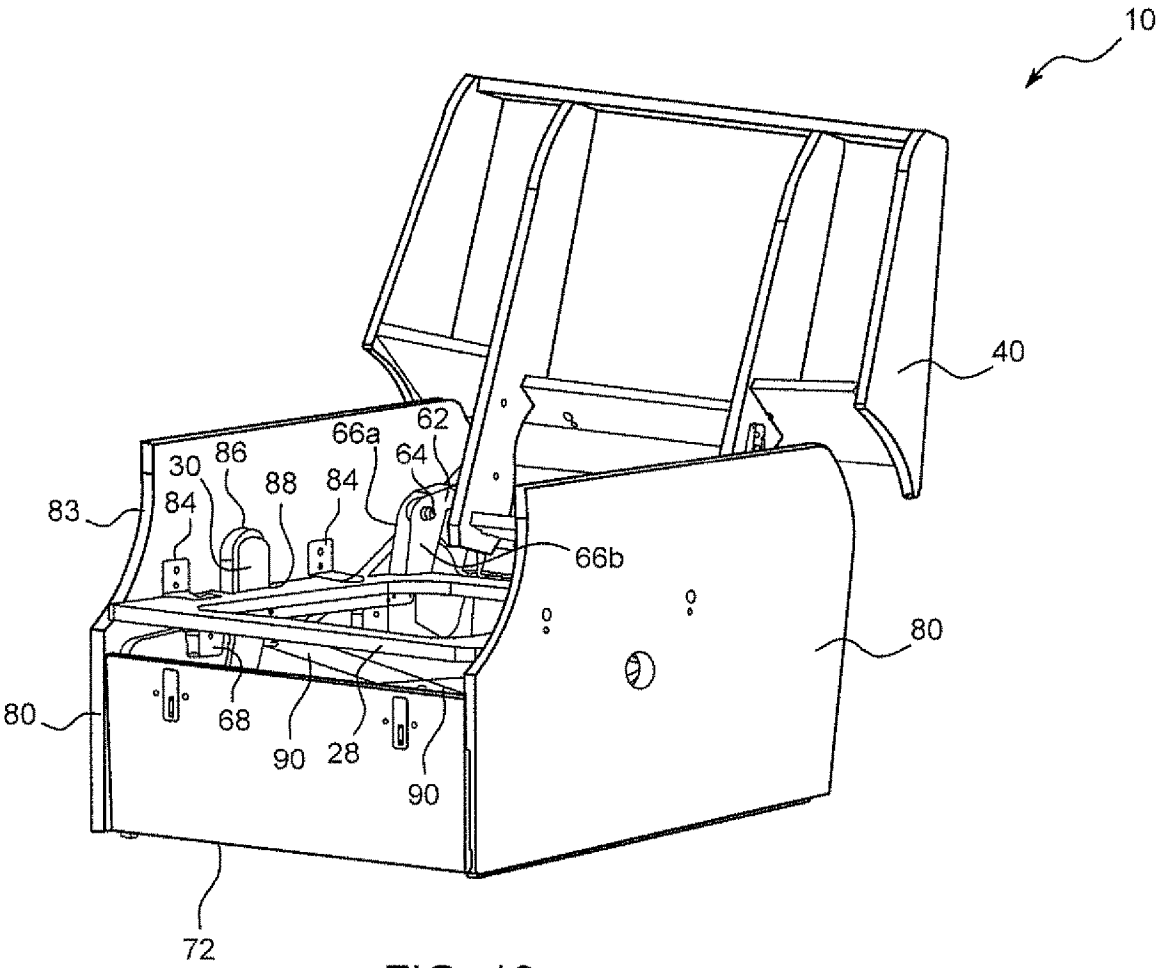
FIG. 19 is perspective view of a lift recliner chair frame according to a second embodiment of the present invention with the chair frame shown in an upright position.
Figure 20:
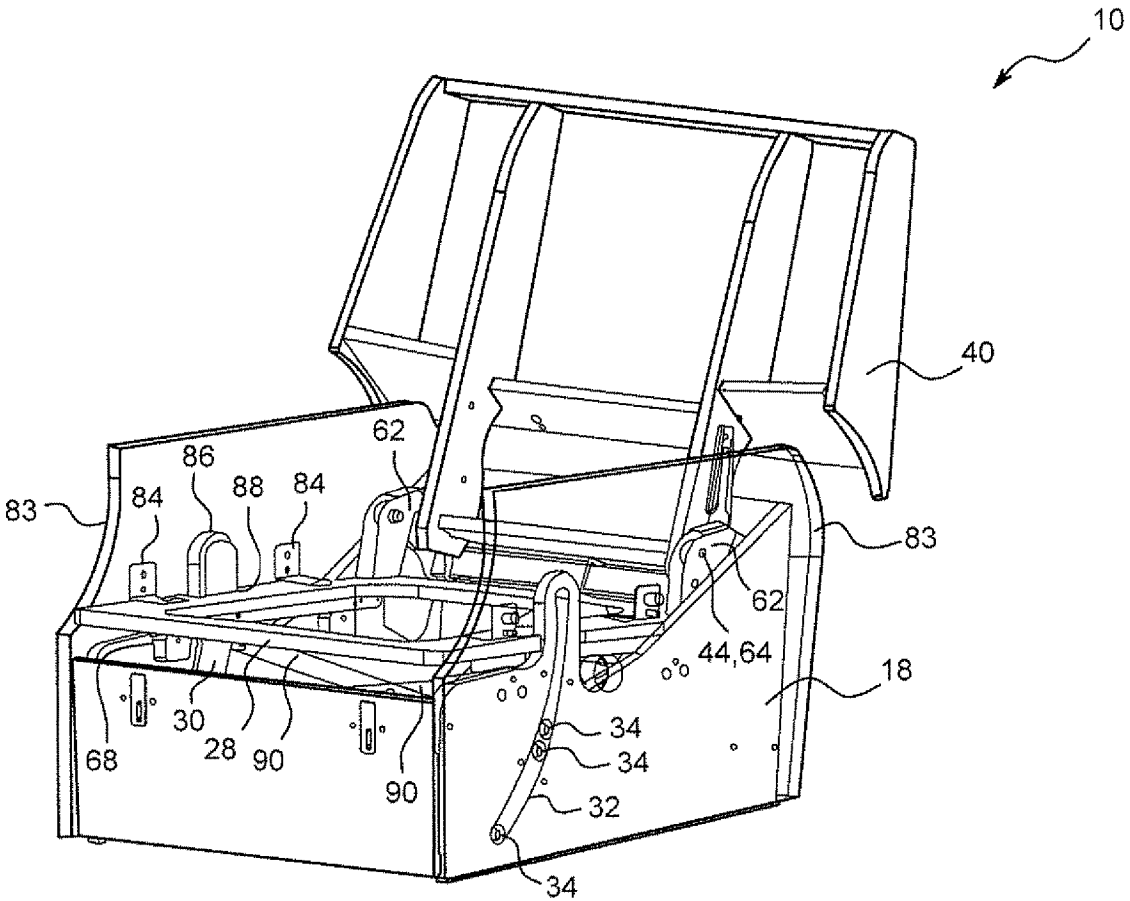
FIG. 20 is perspective view of the chair of FIG. 19 with the seat section left hand side panel of the chair indicated in transparent ghost outline.
Figure 21:
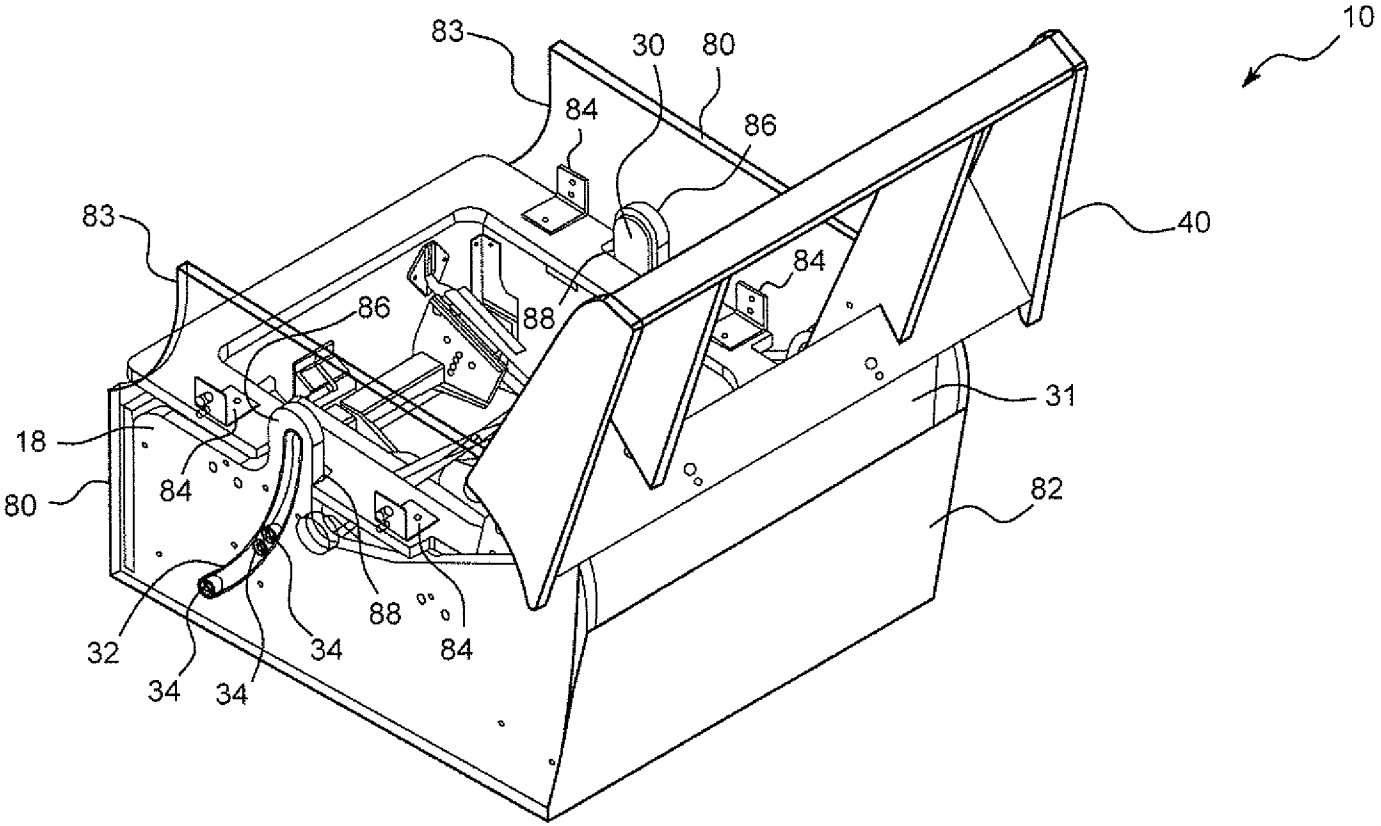
FIG. 21 is perspective view from the rear of the lift-recliner chair frame shown in FIGS. 19 and 20 with the seat section left hand side panel shown in ghost outline, and the chair in the upright configuration of FIGS. 19 and 20.
Figure 22:
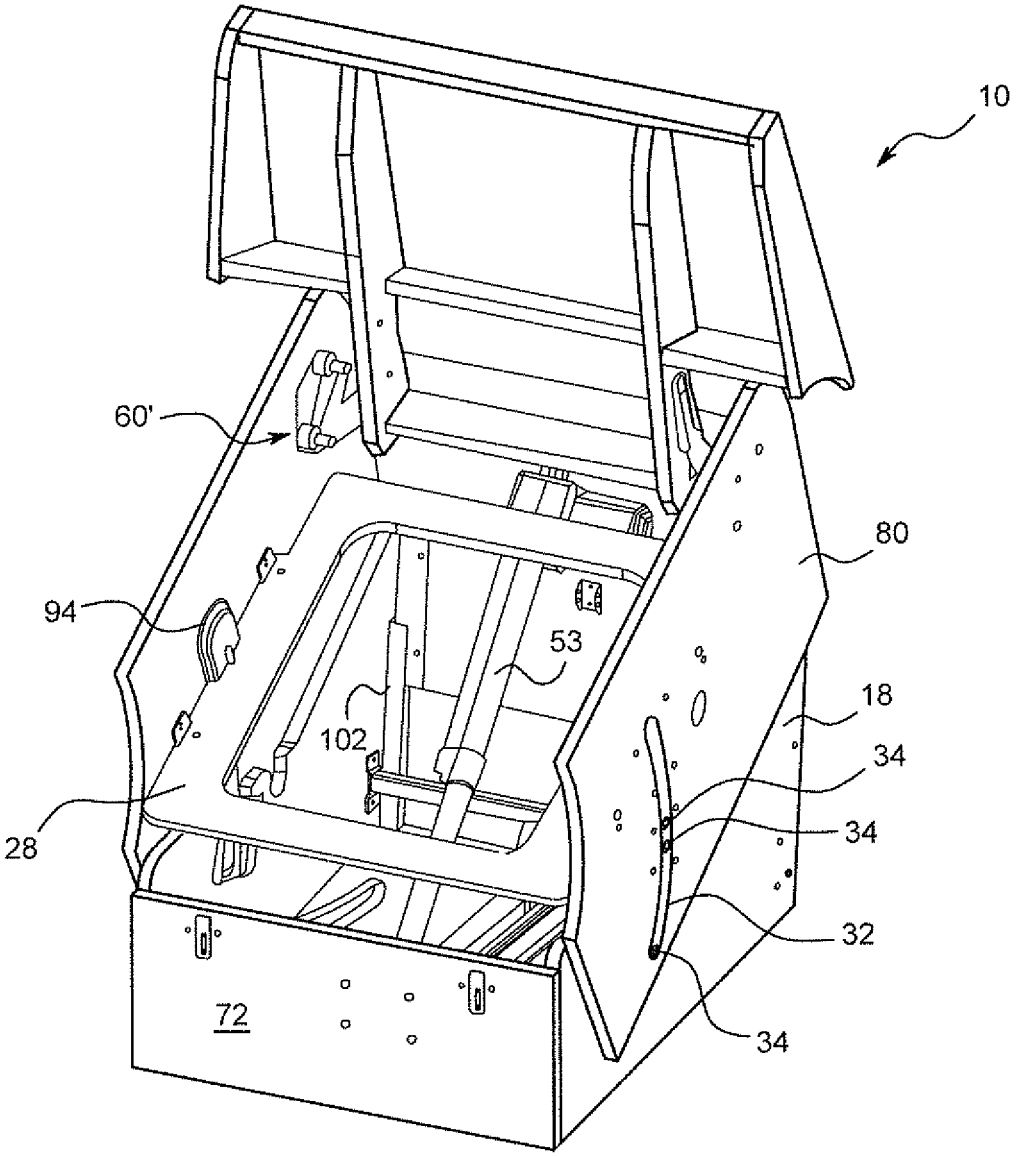
FIG. 22 is perspective view of a lift-recliner chair frame according to a further arrangement, with the chair frame shown in a fully raised position.
Figure 23:
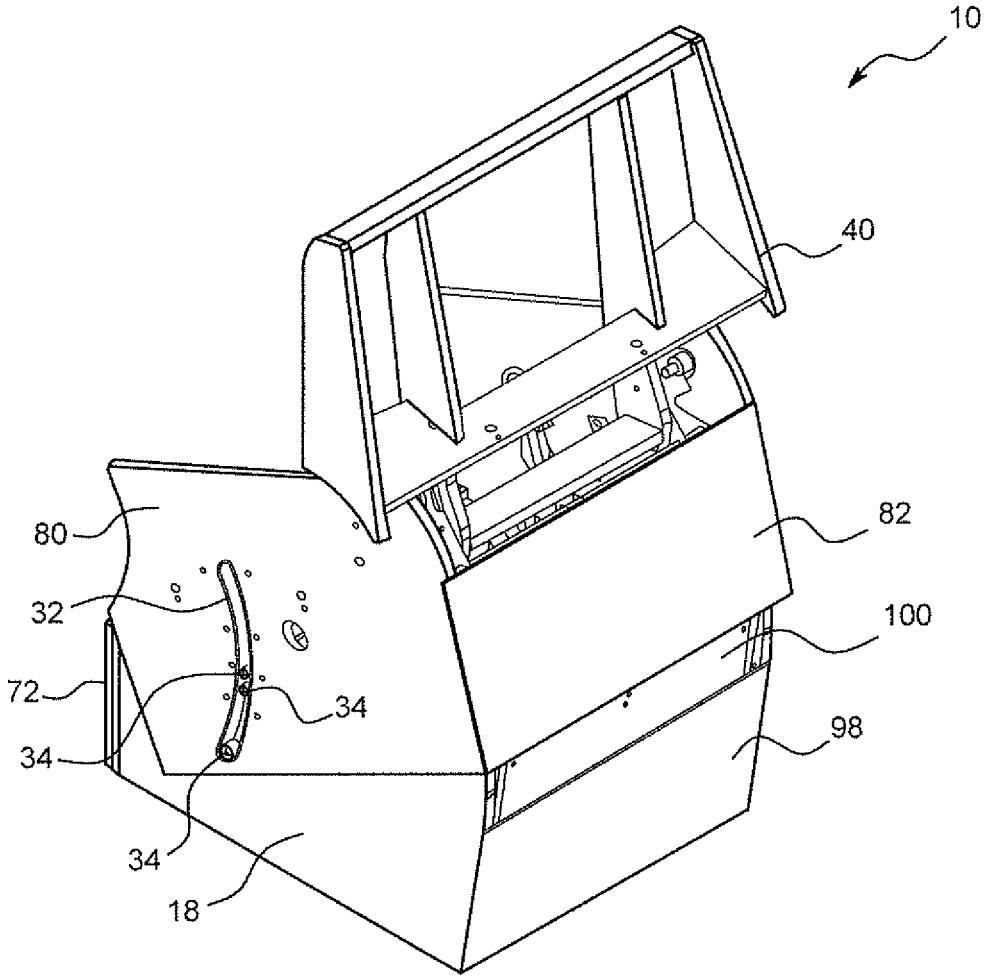
FIG. 23 is a perspective view from the rear of the lift-recliner chair frame of FIG. 22 in a fully raised position.
Figure 24:
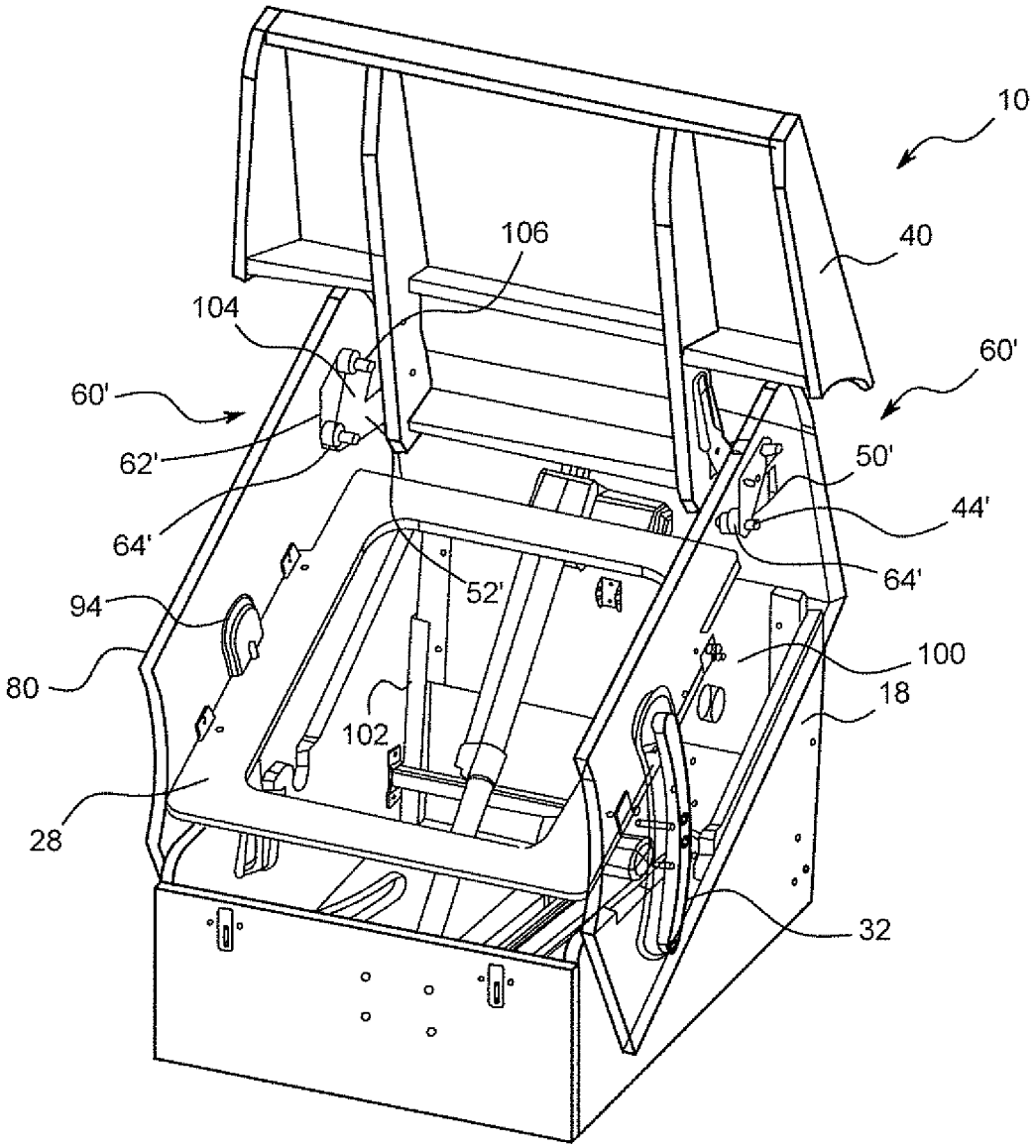
FIG. 24 is perspective view of the chair of FIG. 22, similar to the view of FIG. 22, with the seat section left hand side panel of the chair indicated in transparent ghost outline.
Figure 25:
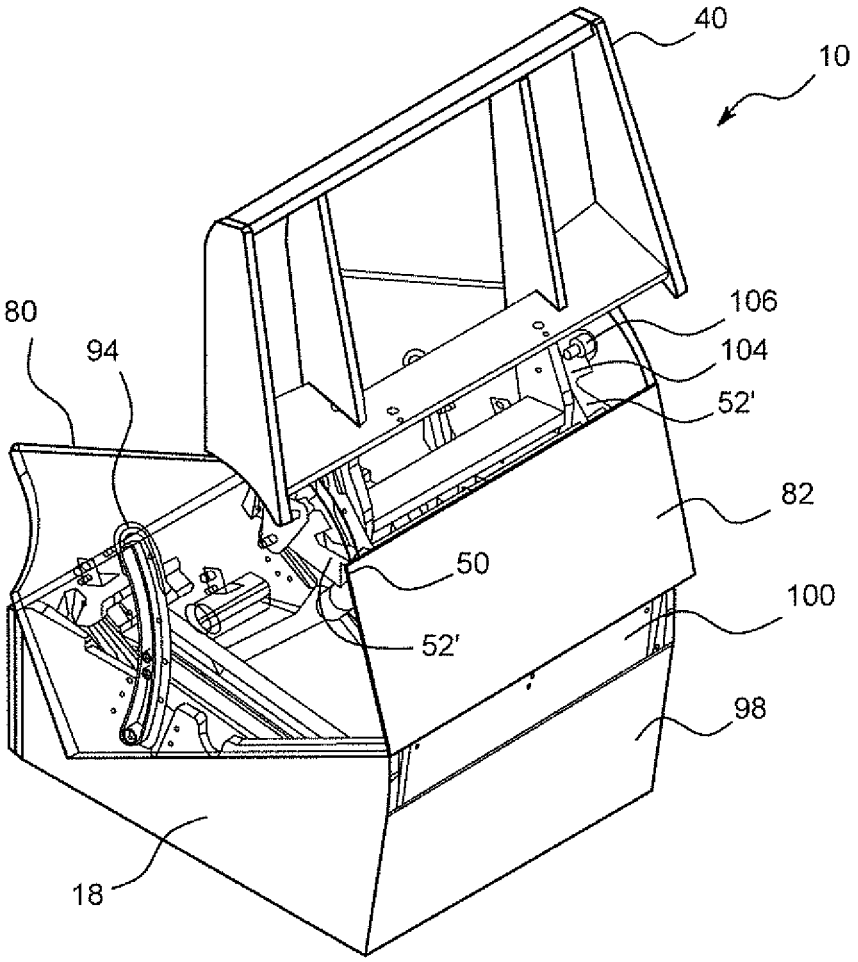
FIG. 25 is a perspective view from the rear of the lift-recliner chair frame shown in FIG. 22 with the seat section left hand side panel shown in ghost outline; and, FIG. 26 is a perspective view of the chair of FIG. 22, similar to the view of FIG. 22, with the seat section left hand side panel and seat cushion support frame of the chair indicated in transparent ghost outline.

Another embodiment of the invention is shown in the drawings of FIGS. 19 to 21. The chair 10 is shown in the upright configuration in FIGS. 19 to 21. In this embodiment, the chair of FIGS. 1 to 15 is modified slightly in that the side panels 18 no longer form the arms of the chair. The panels 18 are cut back and profiled along their top edge and arranged inboard of an additional pair of outer panels 80 which are fixed in relation to the seat frame. The outer panels 80 combine with an additional rear panel 82 to provide an outer frame around the sides of the base section 12. The rear panel 82 extends between, and is fixedly secured to, the panels 80 at the rear of the chair. The panels 80 have a similar shape and size as the panels 18 on the previous embodiment, but additionally include scalloped regions 83 at the upper forward facing edge, mainly for design aesthetics of the finished product, and also have a slightly increased length so that they accommodate the modified inner frame panels 18. The outer panels 80 are fixedly secured to the seat frame 28 at various points along the sides thereof by means of L-shape, preferably metal, brackets 84.

The panels 18 in the present embodiment have a much lower profile than in the previous embodiment. As can best be seen in the drawings of FIGS. 18 and 19, where the left hand side outer panel 80 is shown in transparent ghost outline only, moving rearwards from the front of the chair, the top edge of the panels 18 first extends horizontally at substantially the same height as the top edge of the stowed footrest board 72, but then extends upwards to form an upstanding tongue 86 which accommodates the upper part of the curved guide slot insert 32, then, from a lower position than before the tongue, gently inclines upwards to a point approximately half way along the panel 18 when the incline becomes stepper to the top edge of the rear panel 31.

The sides of the seat frame 28 are also modified in the embodiment of FIGS. 19 to 21. In order to accommodate the tongue section 86 of the panels 18, the sides of the seat frame are wider and provided with respective cut-out sections 88.

In the embodiment of FIGS. 19 to 21 the arms are provided, at least in part, by the outer side panels 80 so that, in contrast to the previous embodiment, the arms rise with the chair as the seat section is moved to its raised position. In this embodiment it will be understood that the side panels 18 and 80 combine to provide lateral shielding of the interior region of the chair, both when lowered and raised, as the inner 31 and outer 82 rear panels do at the rear of the chair. This is provided by the overlapping nature of the side panels 18 and 80, whereby the inner base section frame comprising the panels 18 and rear panel 31 nests with the outer moveable seat section frame comprising the side panels 80 and rear panel 82. The outer frame thereby being telescopically extendable from the stationary inner base section frame.

A further modification to the embodiment of FIGS. 1 to 18 includes the provision of a pair of criss-cross bracing elements 90 which extend between the inner side panels 18 in the interior region of the chair, just rearward of the tongue section 86. The bracing elements 90 combine to increase the stiffness of the base section of the chair, to limit deflection of the base section parts in use.

Referring now to the lift and recline chair frame of FIGS. 22 to 26, which show a further modified arrangement of the chair of the previous embodiments. In this arrangement the rollers 34 are fixed in relation to the base and the guide slots 32 are provided in the outer side panels 80 of the seat section. This is the reverse arrangement to the previously described embodiments where the guide slots are fixed relative to the base in the side panels 18 and the bearing rollers are carried by the downwardly depending arcuate side members 30 attached to the seat frame 28. Thus, the modus operandi of the chair remains the same as before with the pivot of the chair being defined by the centre of curvature of the slots 32, but in reverse arrangement. In addition, the chair of FIGS. 22 to 26 shares a similar nesting type arrangement as the embodiment of FIGS. 19 to 21, with a stationary inner frame, comprising side panels 18, nested within an outer moveable frame comprising side panels 80. As can be seen in the drawings of FIGS. 22 to 26, the side panels 80 overlap with the inner side panels 18 to provide lateral shielding of the interior of the chair as previously described in relation to FIGS. 17 to 21.

Figure 26:
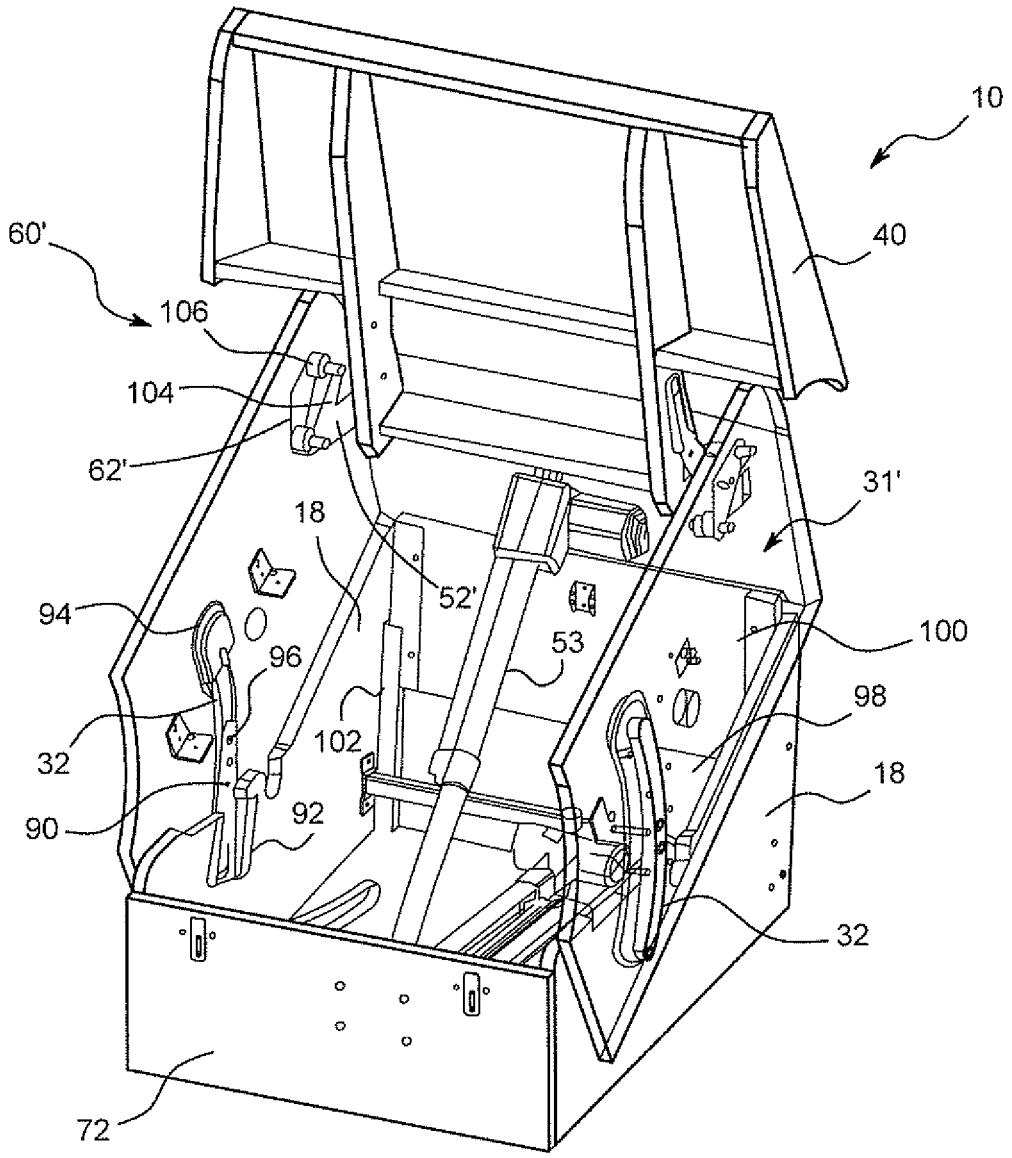

As can best be seen in the drawing of FIG. 26, in which the left hand outer side panel 80 is shown in transparent outline and the seat frame 28 is omitted for the purpose of illustration only, the bearing rollers 34 are mounted on arcuate metal brackets 90 fixed to the side panels 18 on both sides of the inner frame of the base section of the chair. The brackets 90 are located in cut out recesses 92 in the respective side panels, and project upwards of the top edge of the side panels 18 where two of the three bearings 34, on each side of the chair, are mounted for location in the respective slots 32. The circumferential distribution of the bearings 34 on the brackets 90 is such that the bearings 34 furthest apart circumferentially define the extent of movement of the bearings in the slots 32 by mutual engagement with the ends of the slots when the seat section moves relative to the base section of the chair. Hollow pocket members 94 are provided on the respective inward facing sides of the side panels 80 for receiving the rounded ends 96 of the respective mounting brackets when the seat section is lowered. The pocket members 94 thus prevent movement of the ends of the brackets 90 against soft upholstered fabric above the seat frame 28 and on the inward facing sides of the chair in the finished upholstered chair.

In addition, in the chair of FIGS. 22 to 26 the single rear panel 31 of the base section shown in the previous arrangements of FIGS. 1 to 21 is replaced by a two-part panel 31' comprising a fixed lower panel 98 and a movable slideable panel 100. The lower panel 98 is fixed and extends between the rear ends of the side panels 18 as before, but extends only part way up the rear of the base between the side panels 18, approximately just over half way up. The other panel 100 is slideably mounted in runners 102 in the form of metal open section channels fixed at the end of the base to the inward facing surface of respective side panels 18, forward of and immediately adjacent to the lower fixed rear panel 98. The panel 100 is thus slideable in the respective channels 102 between a raised position, as shown in the drawings of FIGS. 22 to 26, when the seat section is raised, and a lowered position when the seat section is lowered and the chair returned to its normal upright configuration. The panels 98 and 100 overlap so that the rear of the chair is closed in all positions of the chair. As can be best be seen in FIG. 25, the slideable panel 100 co-operates with the fixed rear panel 82 of the seat section so that there is no gap between the seat section and the base at the rear of the chair throughout the range of adjustment of the chair. Movement of the panel 100 is co-ordinated with the movement of the seat section relative to the base so that there is no interference between the panels 82 and 100 as the configuration of the chair is adjusted. This co-ordinated movement may be provided by a connection, such as a strap or the like (not shown) between the panel 100 and part of the seat section so that the strap or like element acts as a hoist to raise the panel 100 in the channels 102 as the seat section is raised towards the fully raised position shown in the drawings of FIGS. 22 to 26, with the panel being lowered under gravity, for example, when the seat section is lowered.

Furthermore, in the chair of FIGS. 22 to 26 the pivot mounting arrangement 60 of the previous embodiments is replaced by a modified mounting arrangement 60'. The pivot mounting arrangement 60' is preferably of metal construction and comprises: a tubular cross-member 50' which extends across the width of the chair at the bottom of the backrest frame 40, with ends of the cross-member 50 disposed on respective lateral sides of the chair; a pair of pivot mounting brackets 62' disposed at the rear of the seat section on the inward facing sides of the side panels 80, adjacent respective left and right hand rear corners of the seat frame 28; a pair of lever arms 52' which extend from the respective ends of the cross member 50' to the pivot point 44' where they are mounted on respective pivot pins 64' carried by the respective brackets 62'. The lever arms are cranked at the pivot point 44' to provide an engagement arm 104; and an abutment stop in the form of a pin 106 provided on each of the pivot mounting brackets 62' to limit the extent of upwards pivotal movement of the lever arms by engagement of the arms 104 with the respective pins 106 when the backrest is returned from a lowered or inclined position to its upright position, and subsequently as the seat section is raised in relation to the base section during lifting.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A lift-recliner chair, comprising:

a base section, a movable seat section and a movable backrest section, and an actuator means for moving the seat and backrest sections to alter the configuration of the chair;

the seat section being pivotally mounted with respect to the base section and the backrest section being pivotally mounted with respect to the seat section;

at least one guide on one of the base and the seat sections and at least one follower on the other of the base and the seat sections and movable along said guide;

said guide being of arcuate form to guide the seat for relative pivoting movement with respect to the base about a pivot axis located at the centre of curvature of the guide to raise and lower the chair;

the base section having a pair of parallel side panels on respective lateral sides of the chair; and the seat section having a pair of elongate side members adjacent the side panels, which carry one of said guide and said followers on the seat section;

wherein the elongate side members each further comprise:

an arcuate member, the seat section further comprises:

a seat frame extending laterally between the side members and defining a phane generally parallel with a sitting surface of the seat section; and the side members each comprising a proximal end supported on the seat frame and a distal fee end such that the side members extend in a forwards and downwards direction with respect to the frame, and a major part of the arcuate members extends below the plane of the frame with a concave side of the arcuate embers facing forwards towards the font of the chair.

2. A lift-recliner chair as claimed in claim 1, wherein:

the elongate side members each further comprise:

an arcuate member which is a planar arcuate member.

3. A lift-recliner chair as claimed in claim 2, wherein:

the side members each carry at least two followers, including said at least one follower.

4. A lift-recliner chair as claimed in claim 3, wherein:

said guide is provided as being one of in or on said side panels.

5. A lift-recliner chair as claimed in claim 1, wherein:

the side members lie parallel with the respective side panels.

6. A lift-recliner chair as claimed in claim 5, wherein:

the side members are disposed in the interior region of the chair between the side panels.

7. A lift-recliner chair as claimed in claim 1, wherein:

said actuator means includes a single actuator for co-ordinated movement of both the seat and backrest sections.

8. A lift-recliner chair as claimed in claim 7, wherein:

the single actuator has a first range of movement for moving the backrest with respect to the seat section to provide the recliner function of the chair and a second range of movement for moving the seat section and backrest with respect to the base to provide the lift function of the chair.

9. A lift-recliner chair as claimed in claim 8, wherein:

said first and second ranges of movement are contiguous.

10. A lift-recliner chair as claimed in claim 7, wherein:

movement of the actuator means in said first range exclusively moves the backrest with respect to the seat and base to provide said recliner function and movement of said actuator means in the said second range exclusively moves the seat and backrest with respect to the base to provide said lift function.

11. A lift recliner chair as claimed in claim 8, wherein:

movement of the backrest with respect to the seat section is unfettered in said first range of movement and prevented in said second range of movement by engagement of respective engagement parts of the backrest and seat sections.

12. A lift chair as claimed in claim 11, wherein:

said engagement parts engage by mutual abutment as the said actuator means moves from said first range to said second range, and said parts disengage on the reverse transition thereof.

13. A lift-recliner chair as claimed in claim 8, wherein:

at least part of the seat section is provided with an first engagement part which accommodates a second engagement part of the backrest, which second engagement part moves freely in the first engagement part through said first range of movement and engages an abutment stop of the first engagement part at the transition between said first and second ranges of movement.

14. A lift-recliner chair as claimed in claim 13, wherein:

said backrest includes a cross-member which extends between said first engagement parts with the ends of the cross-member being provided with lever arms accommodated in the respective first engagement parts, said lever arms providing said second engagement parts on both sides of the chair.

15. A lift-recliner chair as claimed in claim 4, wherein:

said actuator is a linear actuator.

16. A lift-recliner chair as claimed in claim 15, wherein:

the said actuator is secured at one end with respect to the said base and at the other end with respect to the backrest.

17. A lift-recliner chair as claimed in claim 15, wherein:

said linear actuator is connected to a cross-member of the backrest.

18. A lift-recliner chair as claimed in claim 1, wherein:

said actuator means comprises a push only actuator.

19. A lift-recliner chair as claimed in claim 1, wherein:

the chair further comprises a pair of armrests; and wherein said armrest are fixed in relation to the base.

20. A lift-recliner chair as claimed in claim 1, wherein:

the seat section further comprises:

a seat frame; and the side members intersect the plane of the seat frame.

21. A lift-recliner chair as claimed in claim 1, wherein:

the seat section further comprises:

a seat frame, and the side members extend in a forwards and downwards direction with respect to the frame.

22. A lift-recliner chair as claimed in claim 2, wherein:

the pivot axis of the seat section is defined by the centre of curvature of said at least one guide and the elongate arcuate side members have a centre of curvature coincident with the pivot axis of the seat section.

23. A lift-recliner chair as claimed in claim 1, further comprising:

an actuator means for moving the seat and backrest sections, characterised in that said actuator means includes a single push only actuator for co-ordinated movement of both the seat and backrest sections.

24. A lift-recliner chair as claimed in claim 23, wherein:

the single actuator has a first range of movement for moving the backrest with respect to the seat section to provide the recliner function of the chair and a second range of movement for moving the seat section and backrest with respect to the base to provide the lift function of the chair.

25. A lift-recliner chair as claimed in claim 24, wherein:

said first and second ranges of movement are contiguous.

26. A lift-recliner chair as claimed in claim 23, wherein:

movement of the actuator means in said first range exclusively moves the backrest with respect to the seat and base to provide said recliner function and movement of said actuator means in said second range exclusively moves the seat and backrest with respect to the base to provide said lift function.

27. A lift recliner chair as claimed in claim 23, wherein movement of the backrest with respect to the seat section is unfettered in said first range of movement and prevented in said second range of movement by engagement of respective engagement parts of the backrest and seat sections.

28. A lift chair as claimed in claim 27, wherein:

said engagement parts engage by mutual abutment as said actuator means moves from said first range to said second range, and said parts disengage on the reverse transition thereof.

29. A lift-recliner chair as claimed in claim 23, wherein:

said actuator is a linear actuator.

30. A lift-recliner chair as claimed in claim 23, wherein:

said actuator is secured at one end with respect to said base and at the other end with respect to the backrest.

* * * * *